US006578952B1

(12) United States Patent
Sugiyama et al.

(10) Patent No.: US 6,578,952 B1
(45) Date of Patent: Jun. 17, 2003

(54) LIQUID DISCHARGING METHOD, LIQUID DISCHARGE HEAD AND RECORDING APPARATUS USING LIQUID DISCHARGE HEAD

(75) Inventors: Hiroyuki Sugiyama, Sagamihara (JP); Sadayuki Sugama, Tsukuba (JP); Hiroyuki Ishinaga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/626,736

(22) Filed: Jul. 26, 2000

(30) Foreign Application Priority Data

Jul. 27, 1999 (JP) ..... 11-212908

(51) Int. Cl.[7] ..... B41J 2/05
(52) U.S. Cl. ..... 347/65; 347/63; 347/65
(58) Field of Search ..... 347/63, 65

(56) References Cited

U.S. PATENT DOCUMENTS

| | | | |
|---|---|---|---|
| 4,723,129 A | 2/1988 | Endo et al. | |
| 5,278,585 A | 1/1994 | Karz et al. | |

FOREIGN PATENT DOCUMENTS

| | | | |
|---|---|---|---|
| EP | 0 436 047 | | 7/1991 |
| EP | 0721841 | * | 7/1996 |
| EP | 0 739 738 | | 10/1996 |
| EP | 0 811 493 | | 12/1997 |
| EP | 0 819 528 | | 1/1998 |
| EP | 0976561 | * | 2/2000 |
| EP | 0976562 | * | 2/2000 |
| JP | 6-31918 | | 2/1994 |
| JP | 9-48127 | | 2/1997 |
| JP | 9-323420 | | 12/1997 |
| JP | 10-24588 | | 1/1998 |

* cited by examiner

*Primary Examiner*—Thinh Nguyen
*Assistant Examiner*—Ly T Tran
(74) *Attorney, Agent, or Firm*—Fitzpatrick, Cella, Harper & Scinto

(57) ABSTRACT

The present invention provides a liquid discharging method that uses a heat generating member for generating thermal energy for generating a bubble in liquid, a discharge port for discharging the liquid, a flow path communicated with the discharge port and having a bubble generating area for generating the bubble in the liquid, a movable member having a free end and capable of being displaced as the bubble grows, and a regulating portion for regulating a displacement amount of the movable member. The flow path is formed by joining a substantially flat substrate including the heat generating body and the movable member to a top plate opposed to the substrate and including the regulating portion and the liquid is discharged from the discharge port by energy generated by generation of the bubble. When both a volume change ratio of the bubble and a displacement volume change ratio of the movable member tend to increase, the displacement of the movable member is regulated by the regulating portion.

33 Claims, 17 Drawing Sheets

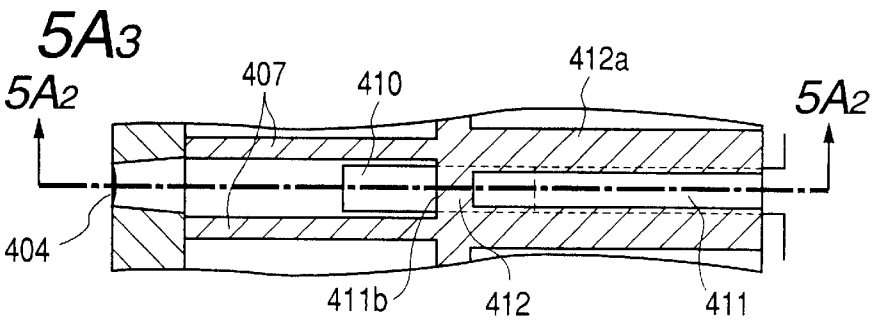
FIG. 5A3
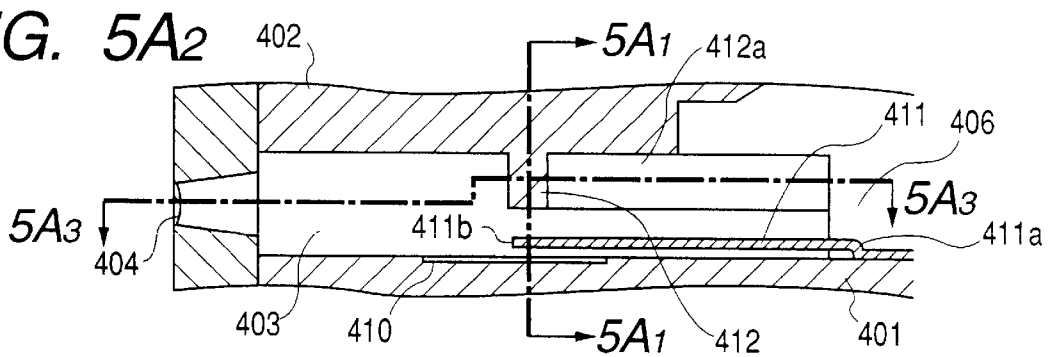
FIG. 5A2
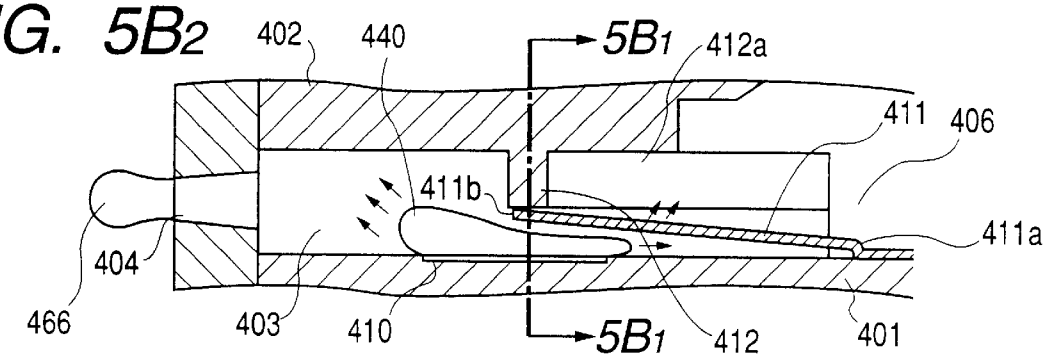
FIG. 5B2
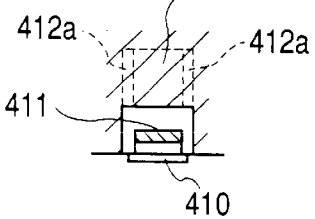
FIG. 5A1
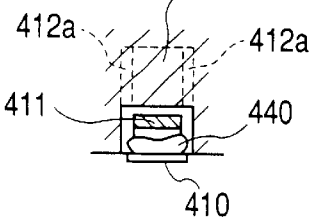
FIG. 5B1

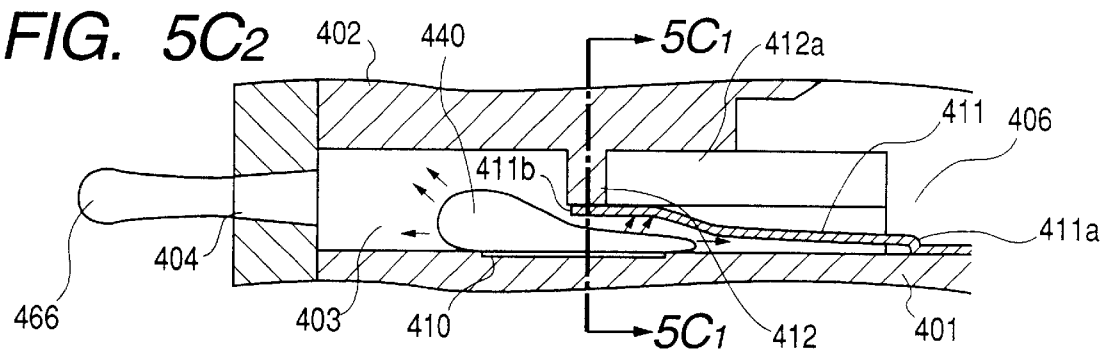
FIG. 5C2
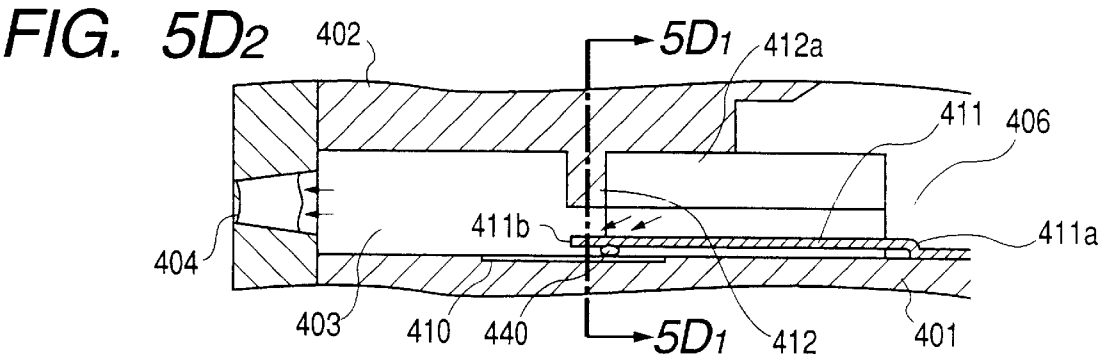
FIG. 5D2
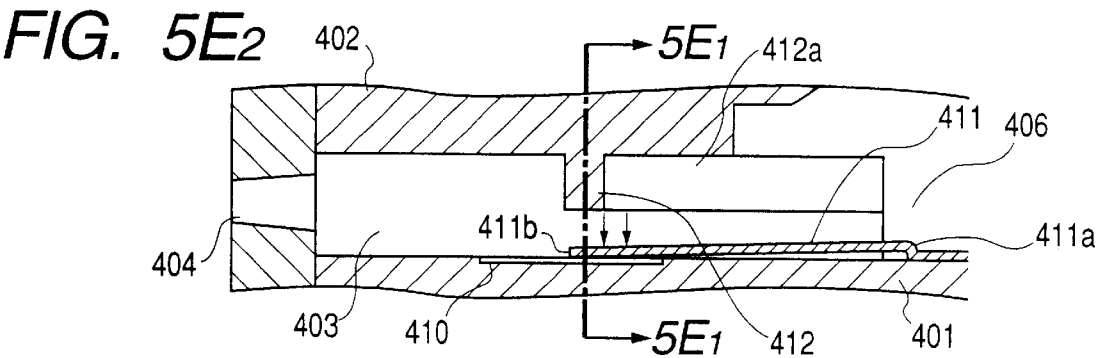
FIG. 5E2
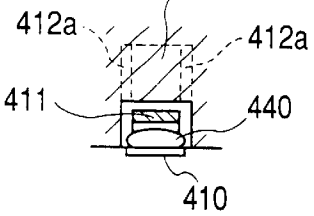
FIG. 5C1
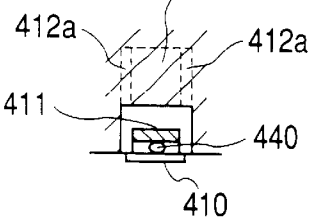
FIG. 5D1
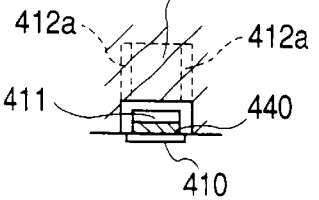
FIG. 5E1

LIQUID DISCHARGING METHOD, LIQUID DISCHARGE HEAD AND RECORDING APPARATUS USING LIQUID DISCHARGE HEAD

BACKGROUND OF THE INVENTION

1. Field of the Invention

The present invention relates to a liquid discharging method, a liquid discharge head and a recording apparatus using such a liquid discharge head, in which desired liquid is discharged by generating a bubble by thermal energy, and more particularly, it relates to a liquid discharge head using a movable separation diaphragm displaced by utilizing generation of a bubble.

Incidentally, a term "recording" in this specification means not only to form a desired image such as character or figure on a recording medium, but also to form a meaningless image such as pattern on a recording medium.

2. Related Background Art

Conventionally, in recording apparatuses such as printers, an ink jet recording method, i.e., a so-called bubble jet recording method in which a bubble is generated by applying energy such as thermal energy to liquid ink in a flow path and the ink is discharged from a discharge port by an acting force generated by abrupt change in volume due to generation of the bubble thereby to adhere the discharged ink to a recording medium to form an image is well known.

As disclosed in U.S. Pat. No. 4,723,129, generally, the recording apparatus using such a bubble jet recording method comprises discharge ports for discharging ink, flow paths communicated with the discharge ports, and electrical/thermal converters as energy generating means for discharging the ink in the flow path(s).

According to such a recording method, since a high quality image can be recorded at a high speed with low noise and the discharge ports can be arranged with high density in a head performing this method, there can be provided many excellent advantages that a recorded image having high resolving power can be obtained by a compact apparatus, a color image can easily be obtained and the like. Thus, the bubble jet recording method has recently been used in many office equipments such as printers, copying machines, facsimiles and the like and has also been applied to industrial systems such as a print device.

As the bubble jet technique is used in wide technical fields, the following requests have recently been made.

A driving condition for providing a liquid discharging method capable of effecting good ink discharge on the basis of high speed ink discharge and stable generation of the bubble in order to obtain the high quality image has been proposed or an improved flow path configuration for obtaining a liquid discharge head having a high speed filling ability for re-filling or replenishing the liquid into the flow path for compensating the discharged liquid in consideration of high speed recording has been proposed.

Other than such heads, as disclosed in Japanese Patent Application Laid-open No. 6-31918, in consideration of a back wave (pressure directing a direction opposite to a direction toward the discharge port) generated by the generation of the bubble, a structure for preventing the back wave leading to loss energy at the discharge port has been proposed. In this proposed technique, a triangular portion of a triangular plate member is opposed to a heater for generating the bubble. In this technique, the back wave is temporarily and slightly suppressed by the plate member. However, since a relationship between the growth of the bubble and the triangular portion is not described at all and there is no such idea, this technique causes the following problems.

That is to say, in this technique, since the heater is located on a bottom of a recess not to be communicated with the discharge port straightly, a shape of a liquid droplet is not stabilized, and, since the growth of the bubble is permitted around an apex of the triangle, the bubble is grown from one side of the triangular plate member to the entire opposite side, with the result that the normal growth of the bubble is completed in the liquid as if there is no plate member. Accordingly, the grown bubble has no relationship to the plate member at all. Conversely, since the entire plate member is enclosed by the bubble, upon contraction of the bubble, the re-fill of the liquid to the heater located in the recess generates turbulent flow, with the result that small bubbles are trapped in the recess, thereby worsening the principle itself for effecting the liquid discharge on the basis of the growth of the bubble.

European Patent Appliction No. 0 436 047 A1 discloses a technique in which a first valve disposed between a discharge port and a bubble generation portion to block communication therebetween and a second valve disposed in the bubble generating portion and an ink supplying portion to completely block communication therebetween are opened and closed alternately (FIGS. 4 to 9 in EP 436047A1). However, in this technique, since these three chambers are partitioned to two chambers, upon discharging, the ink droplet creates a long ink tail to thereby generate many satellite dots in comparison with the normal technique for effecting bubble growth, bubble contraction and bubble extinction (it is guessed that the effect of retarding the meniscus due to bubble extinction cannot be utilized). Further, upon refilling, although the liquid is supplied to the bubble generating portion as a result of the bubble extinction, since the liquid cannot be supplied to the vicinity of the discharge port until the next bubble is generated, not only dispersion in discharged liquid droplets becomes great but also discharge response frequency becomes very small, and, thus, this technique cannot be put to a practical use.

On the other hand, unlike the above technique, the applicant has proposed many techniques in which a movable member (plate-shaped member having a free end disposed near a discharge port and at a downstream side of a fulcrum) contributing to effective discharge of a liquid droplet is used. Among them, Japanese Patent Application Laid-open No. 9-48127 discloses a technique in which an upper limit of displacement of the movable member is regulated to prevent the disturbance of performance of the movable member. Further, Japanese Patent Application Laid-open No. 9-323420 discloses a technique in which a position of a common liquid chamber located at an upstream side of the movable member is shifted toward the free end of the movable member, i.e., toward the downstream direction to enhance the re-filling ability by utilizing the advantage of the movable member. Since these techniques adopt a construction in which the grown bubble is released at once toward the discharge port from a condition that the bubble is temporarily constrained by the movable member, a relationship between the entire bubble and elements associated with the formation of the liquid droplet was not noticed.

In the next step, Japanese Patent Application Laid-open No. 10-24588 discloses a technique in which a part of a bubble generating area is released from the movable member in consideration of growth of the bubble due to pressure wave (acoustic wave) propagation as a factor associated with the liquid discharging. However, also in this technique, since only the growth of the bubble in the liquid discharging is noticed, a relationship between the entire bubble and elements associated with the formation of the liquid droplet was not noticed.

In the past, although the fact that a forward part (edge shooter type) of a bubble generated by film boiling affects a great influence upon the discharging was well known, the fact that such a part is caused to contribute to the formation of the discharge liquid droplet more effectively was not noticed, and the inventors have investigated to analyze such facts.

Further, the inventors noticed a relationship between the displacement of the movable member and the generated bubble and found the following effective technique.

Such a technique regulates the displacement of the free end of the movable member with respect to the growing bubble by a stopper. By regulating the displacement of the movable member by means of the stopper, the growth of the bubble toward the upstream direction is regulated, with the result that energy for discharging the liquid is efficiently transmitted toward the downstream side, i.e., toward the discharge port.

In such investigation step, it was found that the bubble sometimes moves around the tip end of the movable member having the free end capable of being displaced in response to the growth of the bubble under a certain condition during the displacement of the movable member. In the technical analysis, the following phenomenon was ascertained.

That is to say, as the bubble for discharging the liquid droplet grows and the movable member is displaced upwardly, the displacement of the movable member cannot follow the growth of the bubble, with the result that the grown bubble tries to ride on the upper surface of the movable member. However, it was observed that, under a certain condition, for example, in a condition that the resistance of a flow path at the liquid supply side is very small to easily shift the liquid toward the liquid supply side, as the liquid is shifted rearwardly of the nozzle flow path due to the displacement of the movable member, the bubble tends to travel rearward of the nozzle flow path.

When the flow of the liquid toward the rearward of the nozzle flow path is caused during the displacement of the movable member, it was found that the effect of the movable member for efficiently directing the discharge energy generated by the growth of the bubble is sometimes worsened.

To avoid this, the inventors found a flow path structure of a liquid discharge head utilizing a movable member having a free end in which liquid flow toward the rear of the flow path and entering of the bubble into the rear of the flow path are prevented, thereby enhancing the discharging efficiency forward of the nozzle and stabilizing quick return of the meniscus of the re-fill liquid during re-filling.

SUMMARY OF THE INVENTION

An object of the present invention is to provide a liquid discharging method, a liquid discharge head and a recording apparatus using such a liquid discharge head, in which liquid discharge energy generated by a bubble is efficiently transmitted to the liquid and the liquid is stably discharged.

To achieve the above object, in a liquid discharging method according to the present invention, there are provided a heat generating body (member) for generating thermal energy for generating a bubble in liquid, a discharge port for discharging the liquid, a flow path communicated with the discharge port and having a bubble generating area for generating the bubble in the liquid, a movable member having a free end and capable of being displaced as the bubble grows, and a regulating portion for regulating a displacement amount of the movable member, and the flow path is formed by joining a substantially flat substrate including the heat generating body and the movable member to a top plate opposed to the substrate and including the regulating portion and the liquid is discharged from the discharge port by energy generated by generation of the bubble. The liquid discharging method is characterized in that when both a volume change ratio of the bubble and a displacement volume change ratio of the movable member tend to increase, the displacement of the movable member is regulated by the regulating portion.

As mentioned above, in the liquid discharging method according to the present invention, since the displacement of the movable member is regulated by the regulating portion when both the volume change ratio of the bubble and the displacement volume change ratio of the movable member tend to increase, the shifting movement of the liquid toward an upstream side caused when the bubble is generated can be stopped.

A liquid discharge head according to the present invention comprises a heat generating body for generating thermal energy for generating a bubble in liquid, a discharge port for discharging the liquid, a flow path communicated with the discharge port and having a bubble generating area for generating the bubble in the liquid, a movable member having a free end and capable of being displaced as the bubble grows, and a regulating portion for regulating a displacement amount of the movable member, and the flow path is formed by joining a substantially flat substrate including the heat generating body and the movable member to a top plate opposed to the substrate and including the regulating portion and the liquid is discharged from the discharge port by energy generated by generation of the bubble. The liquid discharge head is characterized in that protruded height from a wall surface of the top plate defining an upper wall of the flow path to a tip end of the regulating portion is 20 $\mu$m or more, and a first clearance within the flow path formed by the movable member and the regulating portion in an initial condition that the bubble is not generated is 25 $\mu$m or less.

In the liquid discharge head having the above-mentioned arrangement, since the height of the regulating portion is 20 $\mu$m or more and the first clearance within the flow path formed by the movable member and the regulating portion in the initial condition that the bubble is not generated is 25 $\mu$m or less, when the movable member is displaced toward the top plate by growth of the bubble, the movable member is positively contacted with the regulating portion, thereby positively regulating the displacement amount of the movable member mechanically. Further, by selecting the height of the regulating portion and the first clearance within the flow path formed by the movable member and the regulating portion to the above-mentioned dimensional relationship, when the bubble is extinguished and the movable member contacted with the regulating portion is separated from the regulating portion and displaced toward the substrate, the influence of the regulating portion and the movable member upon flow of the liquid toward the discharge port can be reduced, thereby realizing the smooth liquid re-filling.

The regulating portion of the liquid discharge head according to the present invention may have a tip end regulating portion formed at a position opposed to the free end of the movable member and further may have side regulating portions located aside the bubble generating portion and formed at positions opposed to both lateral sides of the movable member. In this case, since the movable member displaced toward the top plate by the growth of the bubble is contacted with the tip end regulating portion and the side regulating portions, the bubble trying to go round from both lateral sides of the movable member toward the upstream side can be suppressed, thereby promoting the growth of the bubble toward the discharge port.

Further, a second clearance within the flow path formed by a lower surface of the movable member and the substrate in the initial condition that the bubble is not generated may be 5 μm or more, and a thickness of the movable member may be about 5 μm, and a distance between a wall surface of the substrate constituting a lower wall surface of the flow path and the upper wall surface—which distance defines a height of the flow path in the bubble generating area—may be about 55 μm.

Further, the first clearance may be 10 μm or more, and, when the protruded height is 30 μm or more, the first clearance may be 15 μm or less.

Further, the movable member may have a projection protruding from the lower surface toward the substrate. In this case, a third clearance within the flow path formed by the projection and the substrate in the initial condition that the bubble is not generated may be about 5 μm, and, when the protruded height is about 20 μm, the first clearance may be within a range from 10 μm to 15 μm, and the sum of the first clearance and the second clearance within the flow path formed by the lower surface of the movable member and the substrate may be about 30 μm. By providing the projection on the lower surface of the movable member in this way, the growth of the bubble toward the upstream side can be regulated and the growth of the bubble toward the downstream side can be promoted. Further, when the bubble is extinguished and the movable member is displaced toward the substrate, even if the movable member is overshot by exceeding the position in the initial condition, the damage of the free end of the movable member or the substrate due to the contact between the free end and the substrate caused by the contact between the projection and the substrate can be prevented. Further, since the projection absorbs the overshoot energy, a time period for attenuating the overshoot can be shortened.

Further, the movable member may have a parallel portion parallel with the wall surface of the substrate which constitutes the lower wall surface of the flow path, and an upper portion inclined from the parallel portion toward the upper wall surface. In this case, when the protruded height is about 20 μm, the first clearance may be within a range from 10 μm to 15 μm. By selecting the configuration of the movable member in this way, since an adequate sectional area of the flow path at the upstream side of the movable member is maintained, resistance of the flow path at the upstream side of the movable member during the re-filling can be reduced, thereby enhancing the re-filling efficiency. Further, since the free end of the movable member has the configuration inclined obliquely and upwardly, the damage of the free end of the movable member or the substrate due to the contact between the free end and the substrate during the overshooting can be prevented.

Further, the discharge port of the liquid discharge head according to the present invention may be provided above the heat generating body. In this case, a plurality of movable members are formed with respect to one heat generating body, and the plurality of movable members may be located symmetrically with respect to a bubbling center of the heat generating body.

A recording apparatus according to the present invention has conveying means for conveying a recording medium, and holding means for holding the liquid discharge head according to the present invention for effecting recording on the recording medium by discharging the liquid and capable of reciprocally shifting in a direction transverse to a conveying direction of the recording medium.

Incidentally, terms "upstream side" and "downstream side" used in this specification are expressed with respect to a flow direction of the liquid from a supply source of the liquid toward the discharge port through the bubble generating area (or movable member) or with respect to a structural direction.

Further, a term "downstream side" regarding the bubble itself means a downstream side as to the above-mentioned flow direction or the constructural direction with respect to the center of the bubble or a bubble generated at a downstream side of the center of the heat generating body. Similarly, a term "upstream side" regarding the bubble itself means an upstream side as to the above-mentioned flow direction or the structural direction with respect to the center of the bubble or a bubble generated at an upstream side of the area center of the heat generating body.

Further, a term "contact" between the movable member and the regulating portion used in this specification may be an adjacent condition therebetween with the inter position of the liquid of about several μm or may be a direct contact condition therebetween.

BRIEF DESCRIPTION OF THE DRAWINGS

FIGS. 5A1, 5A2, 5A3, 5B1, 5B2, 5C1, 5C2, 5D1, 5D2, 5E1 and 5E2 are schematic side sectional views of a liquid discharge head according to a second embodiment of the present invention and views for explaining liquid discharging steps from the liquid discharge head;

DETAILED DESCRIPTION OF THE PREFERRED EMBODIMENTS (First Embodiment)

Figure 1:
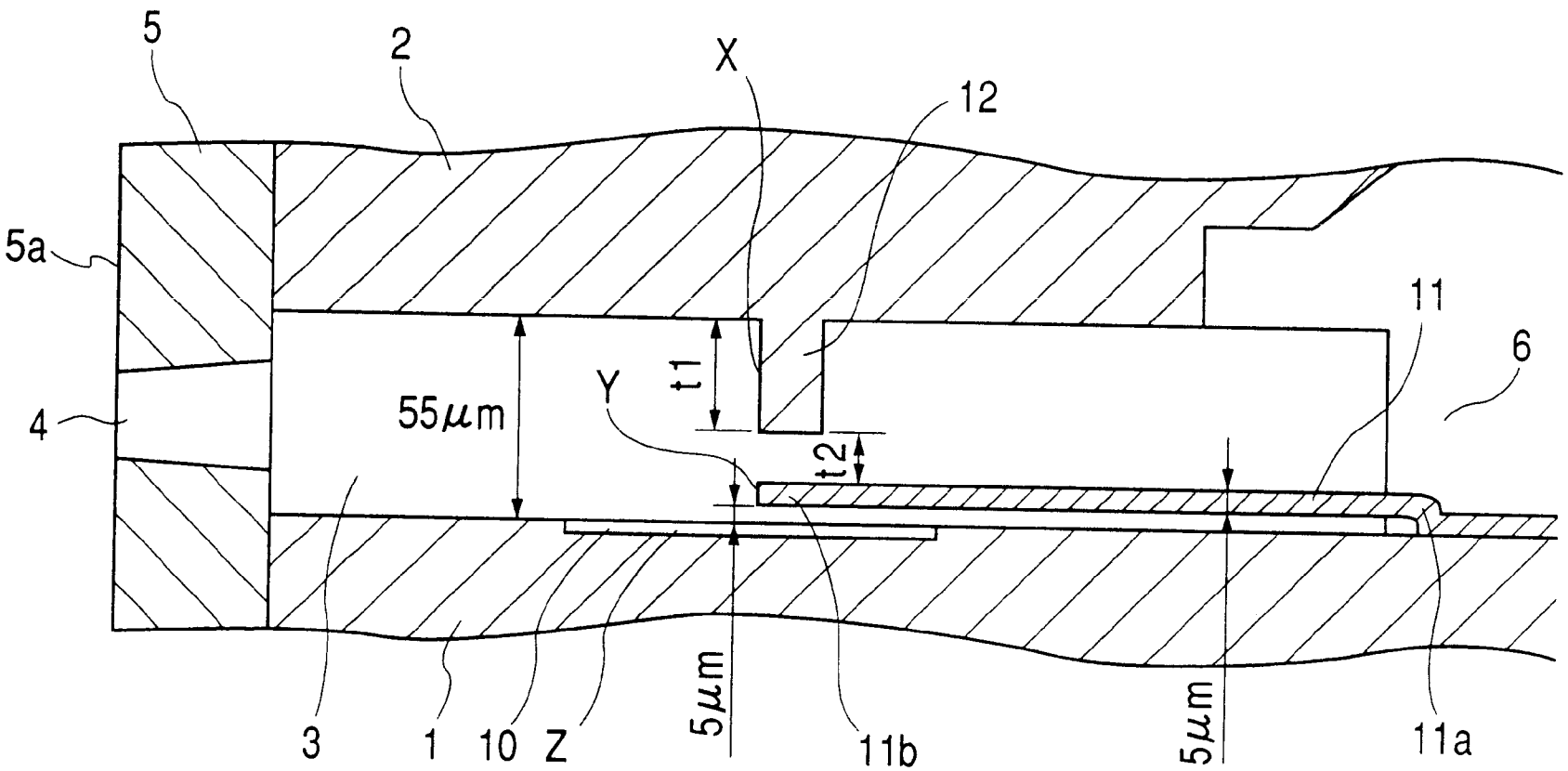
FIG. 1 is a schematic side sectional view of a liquid discharge head according to a first embodiment of the present invention.

FIG. 1 is a schematic side sectional view showing a main part of a liquid discharge head according to a first embodiment of the present invention. Further, FIGS. 2A to 2E are views for explaining liquid discharge steps from the liquid discharge head of FIG. 1.

First of all, a construction of the liquid discharge head will be explained with reference to FIG. 1.

The liquid discharge head has an element substrate 1 including a heat generating body 10 as bubble generating means and a movable member 11, a top plate 2 on which a stopper 12 is formed, and an orifice plate 5 in which a discharge port 4 is formed.

A flow path 3 through which liquid flows is defined by securing the element substrate 1 and the top plate 2 in a laminated condition. Further, the plurality of flow paths 3 are formed side by side in the single liquid discharge head and are communicated with the respective discharge ports 4 formed at a downstream side (left side in FIG. 1) and adapted to discharge the liquid. A bubble generating area is located in the vicinity of a contact area between the heat generating body 10 and the liquid. Further, upstream sides (right sides) of the flow paths 3 are simultaneously communicated with a common liquid chamber 6 having a large volume. Namely, the flow paths 3 is branched from the single common liquid chamber 6. A liquid chamber height of the common liquid chamber 6 is greater than a flow path height of each flow path 3.

The movable member 11 has a cantilever beam shape supported at its one end and is secured to the element substrate 1 at an upstream side of the ink flowing direction. A portion of the movable member at a downstream side of a fulcrum 11*a* can be displaced vertically with respect to the element substrate 1. In an initial condition, the movable member 11 is positioned in parallel with the element substrate 1 with a gap therebetween.

The movable member 11 provided on the element substrate 1 has a free end 11*b* located substantially at a central area of the heat generating body 10. Further, the stopper 12 provided on the top plate 2 serves to regulate an upward displacement amount of the free end 11*b* of the movable member 11 by contacting with the free end 11*b*. When the displacement amount of the movable member 11 is regulated by the contact between the movable member 11 and the stopper 12 (when the movable member is contacted), a portion of the flow path 3 at the upstream side of he movable member 11 and the stopper 12 and a portion of the flow path 3 at the downstream side of the movable member 11 and the stopper 12 are substantially blocked by the movable member 11 and the stopper 12.

It is preferable that a position Y of the free end 11*b* and an end X of the stopper 12 are positioned on a plane perpendicular to the element substrate 1. More preferably, the end X and the position Y are positioned together with a center Z of the heat generating body 10 on the plane perpendicular to the element substrate.

Further, a height of the flow path 3 at the downstream side of the stopper 12 is abruptly increased. With this arrangement, since the bubble at the downstream side of the bubble generating area has sufficient flow path height even when the movable member 11 is regulated by the stopper 12, the growth of the bubble is not obstructed, with the result that the liquid can smoothly be directed toward the discharge port 4, and, since unevenness of pressure balance in a height direction from a lower end to an upper end of the discharge port 4 is reduced, good liquid discharging can be achieved. Incidentally, in a conventional liquid discharge head having no movable member, if such an arrangement was adopted, stagnation was generated at a position where the flow path height is increased at the downstream side of the stopper 12, and the bubble was trapped in this stagnation area. This is not preferable. However, in the first embodiment of the present invention, as mentioned above, since the liquid flow reaches the stagnation area, influence of the bubble trapping is very small.

Further, the top plate configuration at the side of the common liquid chamber 6 abruptly rises at the stopper 12. If there is no movable member in this arrangement, since liquid resistance at the downstream side of the bubble generating area becomes smaller than liquid resistance at the upstream side of the bubble generating area, pressure used for discharging the liquid is hard to be directed toward the discharge port 4. However, in the first embodiment of the present invention, during the formation of the bubble, since the shifting movement of the bubble toward the upstream side of the bubble generating area is substantially prevented by the movable member 11, the pressure used for discharging the liquid is positively directed toward the discharge port 4, and, during the ink supplying, since the liquid resistance at the upstream side of the bubble generating area is small, the ink can be supplied to the bubble generating area swiftly.

According to the above-mentioned arrangement, a growing component of the bubble to the downstream side and a growing component of the bubble to the upstream side are not uniform, and the growing component of the bubble to the upstream side is smaller, with the result that the shifting of the liquid toward the upstream side is suppressed. Since the flow of the liquid toward the upstream side is suppressed, a retard (restriction) amount of meniscus after the discharging is decreased, with the result that a protruded amount of the meniscus protruding from an orifice surface 5*a* is also decreased accordingly in the re-filling operation. Accordingly, the meniscus is suppressed, with the result that stable discharging can be achieved under all driving frequencies from low frequency to high frequency.

Incidentally, in the illustrated embodiment, a "straight communicating condition" that a flow path structure is straight with respect to the flow of the liquid is established between the downstream portion of the bubble and the discharge port 4. More preferably, it is desirable that, by coinciding a propagating direction of pressure wave generated in the generation of the bubble with a moving direction of the liquid caused therefrom, an ideal condition that discharging states of a discharge droplet 66 (described later) such as a discharging direction and a discharging speed are stabilized at a very high level is established. In the illustrated embodiment, as one definition for achieving or approaching the ideal condition, the discharge port 4 and the heat generating body 10—particularly, a portion of the heat generating body 10 at the side (downstream side) of the discharge port 4—may have an arrangement in which they are directly connected by a straight path. In this arrangement, when there is no liquid in the flow path 3, the heat generating body 19, particularly, the downstream side of the heat generating body 10 can be observed.

Next, dimensions of various structural elements will be explained.

In the present invention, the going-round (or migration) of the bubble onto the upper surface of the movable member (going-round of the bubble toward the upstream side of the bubble generating area) was investigated, and it was found that the going-round of the bubble onto the upper surface of the movable member can be prevented by a relationship between a shifting speed of the movable member and a bubble growing speed (i.e., a shifting speed of the liquid), thereby achieving good discharging property.

That is to say, in the present invention, when both a volume changing ratio of the bubble and a displacement volume changing ratio of the movable member tend to be increased, by regulating the displacement of the movable member by the regulating portion, the going-round of the bubble onto the upper surface of the movable member can be prevented, thereby achieving good discharging property.

This will be fully explained with reference to FIGS. 17A to 17C.

Figure 17A:
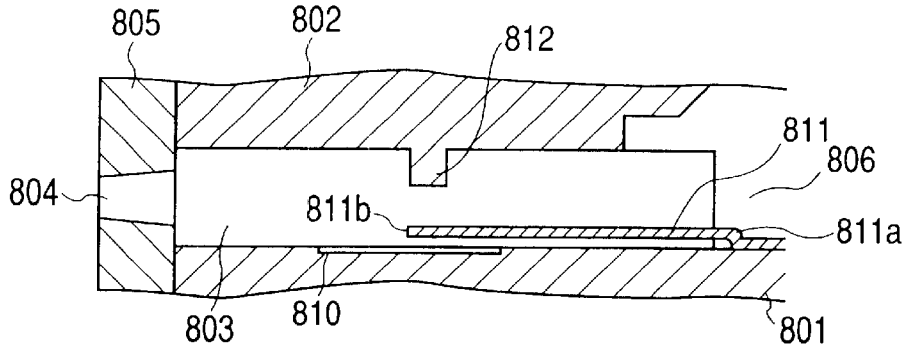
FIGS. 17A, 17B and 17C are views for explaining states in which liquid is flowing into a gap between a movable member and a regulating portion.
Figure 17B:
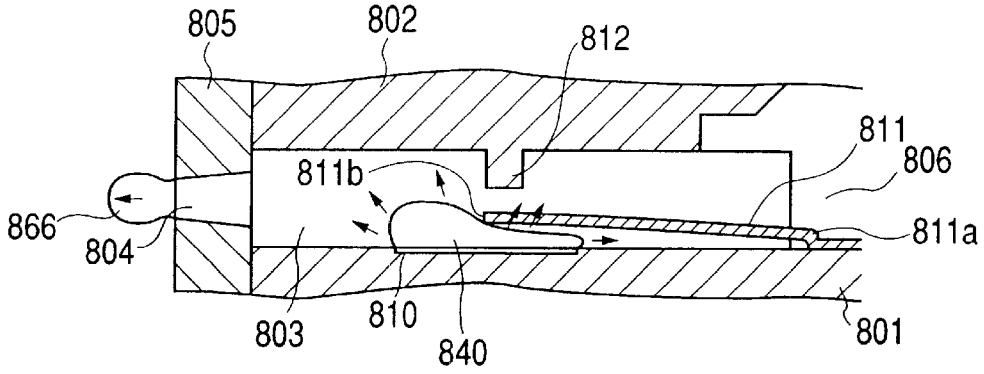
Figure 17C:
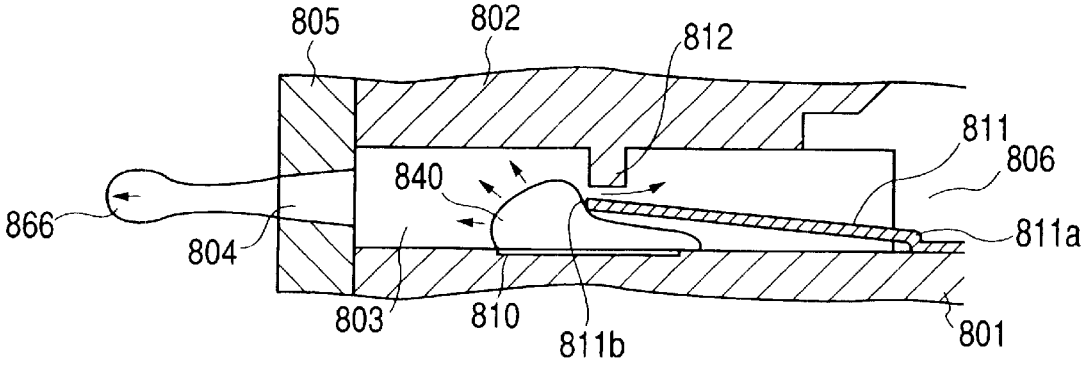

First of all, from a condition shown in FIG. 17A, when a bubble is generated on a heat generating body 810, a pressure wave is generated instantaneously. The bubble is growing by shifting the liquid around the heat generating body 810 by the pressure wave. Initially, a movable member 811 is displaced upwardly to substantially follow the shifting movement of the liquid (FIG. 17B). As the time is further elapsed, since an inertia force of the liquid is decreased, a displacing speed of the movable member 811 is abruptly decreased by elasticity of the movable member 811. In this case, since the shifting speed of the liquid is not so small, a difference between the shifting speed of the liquid and the shifting speed of the movable member 811 is increased. At this point, if there is still a great gap between the movable member 811 (free end 811*b*) and a stopper 812 as shown in FIG. 17C, the liquid is flowing toward the upstream side of the bubble generating area (direction shown by the arrow) through the gap, with the result that the movable member 811 is hard to be contacted with the stopper 812 and a part of a discharging force is lost. Accordingly, in such a case, the sufficient regulating effect (blocking) of the regulating portion (stopper 812) for the movable member 811 cannot be obtained.

To the contrary, in the present invention, the regulation of the regulating portion for the movable member is effected in a condition that the displacement of the movable member follows the shifting movement of the liquid. Here, in the present invention, for convenience sake, the displacing speed of the movable member and the growing speed of the bubble (shifting speed of the liquid) are expressed as "movable member displacement volume changing ratio" and "bubble volume changing ratio", respectively. Incidentally, the "movable member displacement volume changing ratio" and "bubble volume changing ratio" are obtained by differentiating the displacement volume of the movable member and the volume of the bubble.

With this arrangement, since the liquid flow tending to cause the going-round of the bubble onto the upper surface of the movable member 811 is substantially eliminated and the sealing condition of the bubble generating area can be obtained more positively, the good discharging property can be achieved.

Further, according to this arrangement, after the movable member 811 is regulated by the stopper 812, the bubble 840 continues to grow. In this case, in order to promote free growth of a downstream component of the bubble 840, it is desirable that a sufficient distance (protruded height of the stopper 812) between the stopper 812 and a surface (upper wall surface) of the flow path 3 opposed to the substrate 1 be maintained.

Incidentally, in the present invention, the regulation of the regulating portion for the displacement of the movable member means a condition that the displacement volume changing ratio becomes zero or a negative value.

The height of the flow path 3 is 55 $\mu$m, a thickness of the movable member 811 is 5 $\mu$m, and clearance between the lower surface of the movable member 811 and the upper surface of the element substrate 1 in a condition that the bubble is not generated (the movable member 811 is not displaced) is 5 $\mu$m.

Further, when it is assumed that a height from the flow path wall surface of the top plate 2 to the tip end of the stopper 812 is t1 and clearance between the upper surface of the movable member 811 and the tip end of the stopper 812 is t2, in a case where t1 is 30 $\mu$m or more, by selecting t2 to be 15 $\mu$m or less, the stable discharging property for the liquid can be achieved, and in a case where t1 is 20 $\mu$m or more, it is preferable that t2 be selected to be 25 $\mu$m or less.

Next, a discharging operation of the liquid discharge head according to the illustrated embodiment will be fully explained with reference to FIGS. 2A to 2E, and FIG. 3 showing change in displacing speed and volume of the bubble and change in displacing speed and displacement volume of the movable member with respect to time.

Figure 2A:
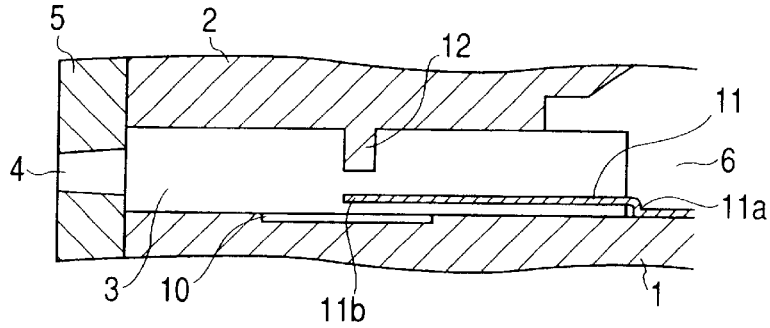
FIGS. 2A, 2B, 2C, 2D and 2E are views for explaining liquid discharging steps from the liquid discharge head of FIG. 1.
Figure 3:
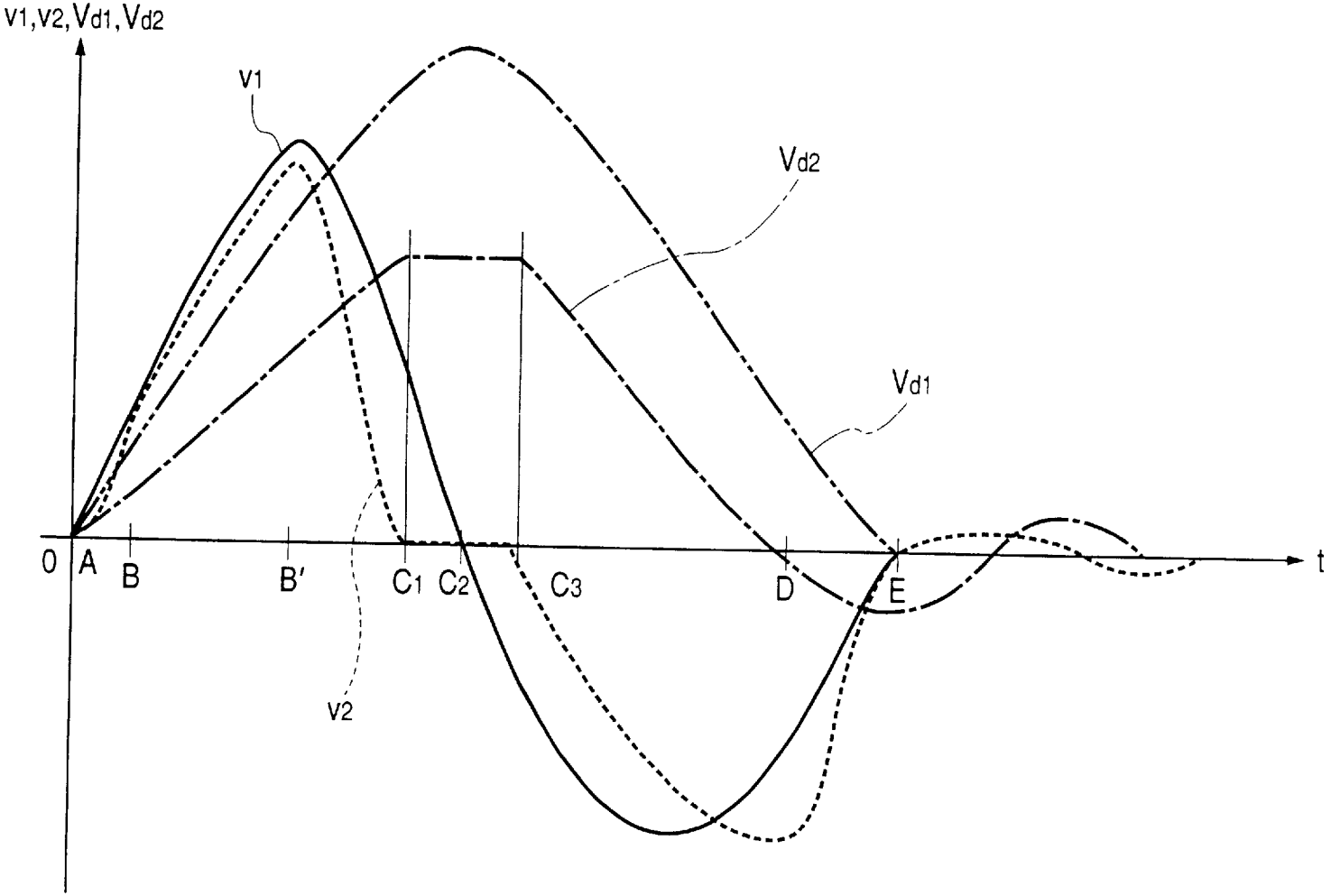
FIG. 3 is a view showing change in a displacing speed and a volume of a bubble with respect to time and change in a displacing speed and a displacement volume of a movable member.

In FIG. 3, the bubble volume changing ratio v1 is indicated by the solid line, the bubble volume Vd1 is indicated by the two dot and chain line, the movable member displacement volume changing ratio v2 is indicated by the broken line, and the movable member displacement volume Vd2 is indicated by the dot and chain line, respectively. Further, the bubble volume changing ratio v1 is regarded as "positive" with respect to increase of the bubble volume Vd1, the bubble volume Vd1 is regarded as "positive" with respect to increase of the volume, the movable member displacement volume changing ratio v2 is regarded as "positive" with respect to increase of the movable member displacement volume Vd2, and the movable member displacement volume Vd2 is regarded as "positive" with respect to increase of the volume. Incidentally, regarding the movable member displacement volume Vd2, since the volume when the movable member 11 is displaced from a condition shown in FIG. 2A toward the top plate 2 is positive, when the movable member 11 is displaced from the initial condition toward the element substrate 1, the movable member displacement volume Vd2 indicates a negative value.

FIG. 2A shows a condition before energy such as electrical energy is applied to the heat generating body 10 and therefore indicates a condition before the heat generating body 10 generates heat. As will be described later, the movable member 11 is located at an area where the movable member is opposed to an upstream half of the bubble generated by the heat of the heat generating body 10.

In FIG. 3, this condition corresponds to a point A where time t=0.

Figure 2B:
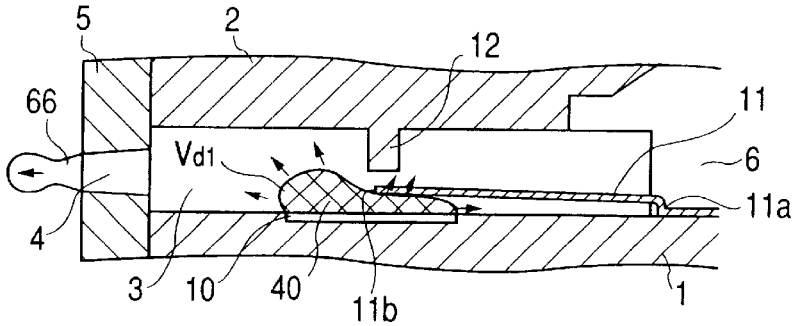

FIG. 2B shows a condition that part of the liquid filling the bubble generating area is heated by the heat generating body 10 and the bubble generation due to film boiling starts. In FIG. 3, this condition corresponds to a duration from a point B to the vicinity of a point C1. In this condition, the bubble volume Vd1 becomes great gradually as the time is elapsed. Incidentally, in this case, the displacement of the movable member 11 is started later than the initiation of the volume change of the bubble 40. That is to say, the pressure wave generated by the generation of the bubble 40 due to the film boiling is propagated within the flow path 3 and the liquid is shifted from the central portion of the bubble generating area toward the downstream side and the upstream side accordingly, and, in the upstream side, the movable member 11 starts to be displaced by the flow of the liquid caused by the growth of the bubble 40. Further, the liquid shifting toward the upstream side passes between the wall surface of the flow path 3 and the movable member 11 and directs toward the common liquid chamber 6. At this point, the clearance between the stopper 12 and the movable member 11 is narrowed as the movable member 11 is displaced. In this condition, the discharge droplet 66 is discharged from the discharge port 4.

Figure 2C:
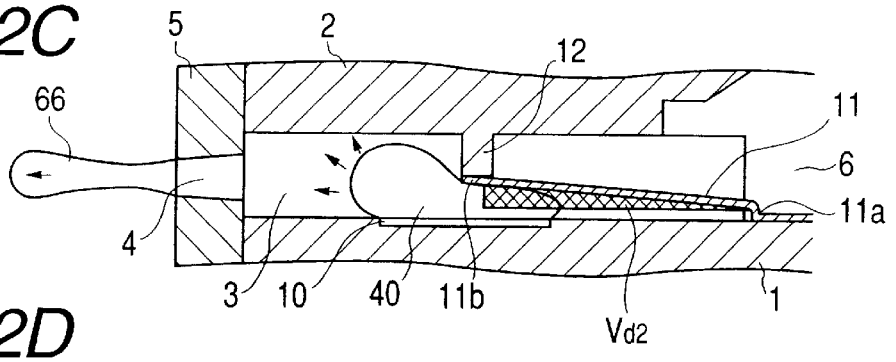

FIG. 2C shows a condition that the free end 11*b* of the movable member 11 displaced by the growth of the bubble 40 is contacted with the stopper 12. This condition corresponds to a duration between a point C to a point C3.

The movable member displacement volume Vd2 is abruptly decreased before the condition shown in FIG. 2C (that the movable member 11 is contacted with the stopper 12) from the condition shown in FIG. 2B, i.e., abruptly decreased at a point B' between the points B and C1. The reason is that, immediately before the movable member 11 is contacted with the stopper 12, the flow resistance of the liquid between the movable member 11 and the stopper 12 is increased abruptly. Further, the bubble volume changing ratio v1 is also decreased abruptly.

Thereafter, the movable member 11 further approaches the stopper 12 and then contacts the stopper. The contact between the movable member 11 and the stopper 12 is positively realized because the height t1 of the stopper 12 and the clearance between the upper surface of the movable member 11 and the top end of the stopper 12 are defined as mentioned above. When the movable member 11 is contacted with the stopper 12, since the further upward displacement is regulated (points C1 to C3 in FIG. 3), the shifting movement of the liquid toward the upstream side is also greatly regulated there. As a result, the growth of the bubble 40 toward the upstream side is also regulated by the movable member 11. However, the shifting force of the liquid toward the upstream side is great, the movable member 11 is subjected to great stress pulling it toward the upstream side, with the result that the movable member is slightly deformed upwardly in a convex shape. Incidentally, in this case, while the bubble is still growing, since the growth of the bubble toward the upstream side is regulated by the stopper 12 and the movable member 11, the downstream portion of the bubble 40 is further grown, with the result that the growing height of the bubble at the downstream side is increased in comparison with the case where the movable member 11 is not provided. That is to say, as shown in FIG. 3, although the movable member displacement volume Vd2 becomes zero between the points C1 and C3 because the movable member 11 is contacted with the stopper 12, since the bubble is grown toward the downstream side, the bubble continues to grow up to a point C2 slightly delayed from the point C1 in time, and the bubble volume Vd1 becomes maximum at this point C2.

On the other hand, as mentioned above, since the displacement of the movable member 11 is regulated by the stopper 12, the upstream portion of the bubble 40 retains a small size to such an extent that the movable member is deformed toward the upstream side in the convex shape to cause stress. In this upstream portion of the bubble 40, an amount entering into the upstream side is regulated to be substantially zero by the stopper 12, side walls of the flow path, the movable member 11 and the fulcrum 11*a*.

In this way, the liquid flow toward the upstream side is greatly regulated, and cross-talk of the liquid to the adjacent flow path and/or back flow of the liquid tending to obstruct high speed re-filling in the liquid supply system and/or pressure vibration are prevented.

Figure 2D:
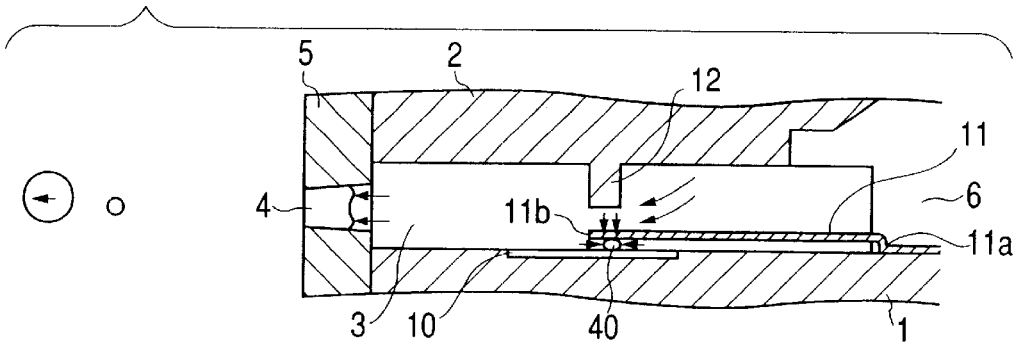

FIG. 2D shows a condition that, after the film boiling, negative pressure in the bubble 40 overcomes the shifting movement of the liquid toward the downstream side in the flow path to start contraction of the bubble 40.

As the bubble 40 is contracted (from point C2 to point E in FIG. 3), although the movable member 11 is displaced downwardly (from point C3 to D in FIG. 3), since the movable member 11 itself has stress due to its cantilever spring form and stress due to the above-mentioned convex deformation, the speed of downward displacement is increased. As a result, the liquid flowing toward the downstream side at the upstream side of the movable member 11, i.e., at low flow path resistance areas formed between the common liquid chamber 6 and the flow path 3 flows into the flow path 3 through the stopper 12 as great flow because the flow path resistance is small. In this operation, the liquid in the common liquid chamber 6 is directed into the flow path 3. The liquid directed into the flow path 3 passes between the stopper 12 and the downwardly deformed movable member 11 and flows into the downstream side of the heat generating body 10 and at the same time acts to accelerate the extinction of the bubble 40. After the liquid aids the extinction of the bubble, the liquid further flows toward the discharge port 4 to aid the restoring of the meniscus, thereby enhancing the refilling speed.

At this point, the discharge droplet 66 discharged from the discharge port 4 forms a liquid droplet which is in turn flying toward the outside.

Further, since the liquid passed between the movable member 11 and the stopper 12 and flown into the flow path 3 increases the flow speed at the wall surface of the top plate 2, fine bubbles are not almost trapped at this area, thereby contributing to the stable discharging.

Further, since a point where cavitation is generated due to extinction of the bubble is shifted toward the downstream side of the bubble generating area, damage to the heat generating body 10 is reduced. At the same time, since adhesion of burned ink to the heat generating body at this area is reduced due to such phenomenon, the discharging stability is improved.

Figure 2E:
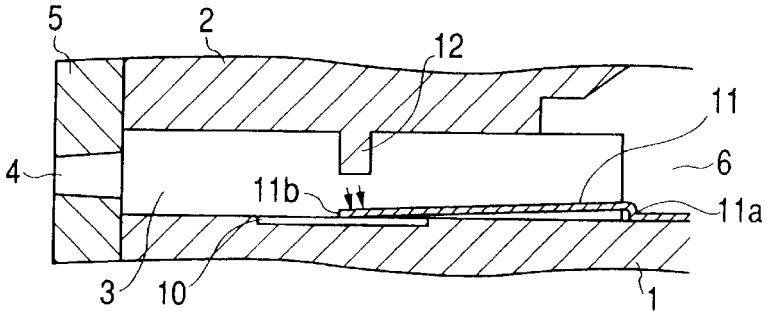

FIG. 2E shows a condition that, after the bubble 40 is completely extinguished, the movable member 11 is overshot and displaced downwardly from the initial condition (right from point E in FIG. 3).

Although depending upon the rigidity of the movable member 11 and viscosity of the liquid used, the overshooting of the movable member 11 is attenuated for a short time, and the movable member is returned to the initial condition.

Figure 4:
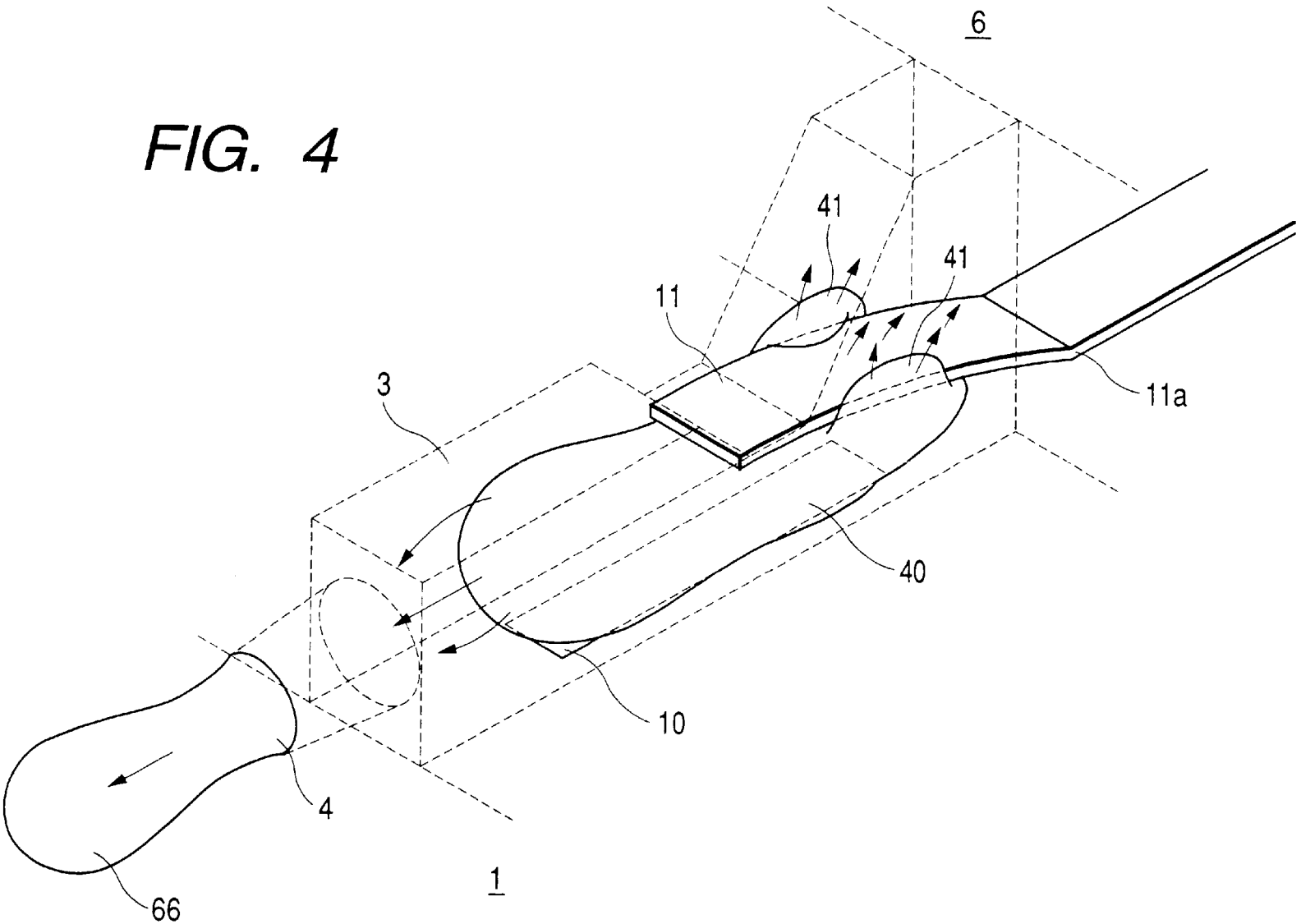
FIG. 4 is a perspective view showing a part of a head of FIG. 1.

Next, particularly a rising bubble 41 rising from both sides of the movable member 11 and the meniscus of the liquid at the discharge port 4 will be explained with reference to FIG. 4 which is a perspective view showing a part of the head shown in FIG. 1. Incidentally, although a configuration of the stopper 12 and a configuration of the low flow path resistance area 3*a* at the upstream side of the stopper 12 shown in FIG. 4 are different from those shown in FIG. 1, the fundamental properties thereof are the same.

In the illustrated embodiment, there are slight clearances between both side wall surfaces defining the flow path 3 and both sides of the movable member 11, thereby permitting smooth displacement of the movable member 11. Further, during the growth of the bubble by the heat generating body 10, the bubble 40 displaces the movable member 11 and is rising toward the upper surface of the movable member 11 through the clearances to slightly enter into the low flow path resistance area 3*a*. The penetrated rising bubbles 41 go round toward the back surface of the movable member 11 (surface opposite to the bubble generating area) to suppress the aberration of the movable member 11, thereby stabilizing the discharging property.

Further, during the extinction of the bubble 40, the rising bubbles 41 promote the liquid flow from the low flow path resistance area 3*a* to the bubble generating area, with the result that the extinction of the bubble is swiftly completed with the aid of the high speed retraction of the meniscus from the discharge port 4. Particularly, due to the presence of the liquid flow generated by the rising bubbles 41, the bubbles are not almost trapped at corners of the flow path 3 and the movable member 11.

In this way, in the liquid discharge head having the above-mentioned construction, at a moment when the liquid is discharged from the discharge port 4 by the generation of the bubble 40, the discharge droplet 66 is discharged as a liquid post (column) having a spherical portion at its tip end. Although this is also true in the conventional heads, in the illustrated embodiment, during the growth of the bubble, the movable member 11 is displaced, and, when the displaced movable member 11 is contacted with the stopper 12, the flow path 3 including the bubble generating area is substantially closed except for the discharge port 4 to define a substantially closed space. Accordingly, when the bubble is extinguished in this condition, since the above-mentioned closed space is maintained until the movable member 11 is separated from the stopper 12 due to the extinction of the bubble, almost all of extinguishing energy of the bubble acts as a force for shifting the liquid in the vicinity of the discharge port 4 in the upstream direction. Consequently, immediately after the extinction of the bubble 40 is started, the meniscus from the discharge port 4 is quickly retracted into the flow path 3, with the result that the tail portion connected to the discharge droplet 66 to form the liquid post at the outside of the discharge port 4 is quickly cut or separated with a strong force by the meniscus. As a result, the satellite dot formed from the tail portion becomes small, thereby improving the recording quality.

Further, since the tail portion does not continue to be pulled by the meniscus for a long time, the discharging speed is not decreased, and, since the distance between the discharge droplet 66 and the satellite dot is shortened, behind the discharge droplet 66, the satellite dot is attracted by a so-called slip stream phenomenon. As a result, a liquid discharge head in which the satellite dot can be combined with the discharge droplet 66 to substantially eliminate the satellite dot can be provided.

Further, according to the illustrated embodiment, in the aforementioned liquid discharge head, the movable member 11 is provided to suppress only the bubble 40 growing toward the upstream direction with respect to the liquid flow directed toward the discharge port 4. More preferably, the free end 11*b* of the movable member 11 is located substantially at the central portion of the bubble generating area. With this arrangement, the inertia force of the liquid and the back wave directed toward the upstream side caused due to the growth of the bubble and not directly associated with the discharging of the liquid can be suppressed and the growing component of the bubble toward the downstream side can be directed toward the discharge port 4 gently.

Further, since the flow path resistance of the low flow path resistance area 3*a* opposite the discharge port 4 with respect to the stopper 12 is small, the liquid shifting toward the upstream direction due to the growth of the bubble 40 becomes a greater flow in the low flow path resistance area 3*a,* with the result that, when the displaced movable member 11 is contacted with the stopper 12, the movable member 11 is subjected to stress pulling it toward the upstream side. Consequently, in this condition, even when the extinction of the bubble is started, since the shifting force of the liquid toward the upstream direction due to the growth of the bubble 40 is maintained, the above-mentioned closed space can be maintained for a predetermined time period until the repelling force of the movable member 11 overcomes such shifting force. That is to say, with this arrangement, high speed retraction of the meniscus can be achieved more positively. Further, when the bubble 40 is further extinguished and the repelling force of the movable member 11 overcomes the shifting force of the liquid toward the upstream direction due to the growth of the bubble, the movable member 11 is displaced downwardly to try to return to the initial condition, with the result that the liquid flow toward the downstream direction is generated in the low flow path resistance area 3*a*. Since the flow path resistance is small, the liquid flow toward the downstream direction in the low flow path resistance area 3*a* becomes the greater flow swiftly and flows into the flow path 3 through the stopper 12. As a result, the retraction of the meniscus is quickly braked by the downstream shifting of the liquid toward the discharge port 4, thereby attenuating the vibration of the meniscus at a high speed.

As mentioned above, in the liquid discharge head according to the illustrated embodiment, since the height of the stopper 12 and the clearance between the upper surface of the movable member 11 and the tip end of the stopper 12 are selected to the dimensional values as mentioned above, the movable member 11 is positively contacted with the stopper 12, with the result that the liquid discharging energy can be transmitted to the liquid efficiently and the liquid is discharged stably, thereby surely realizing the desired discharging property.

Further, when the bubble volume changing ratio and the movable member displacement volume changing ratio tend to increase, since the displacement of the movable member is regulated by the regulating portion, the going-round of the bubble toward the upper surface of the movable member is prevented, thereby obtaining the good discharging property.

(Second Embodiment)

FIGS. 5A1 to 5A3, 5B1, 5B2, 5C1, 5C2, 5D1, 5D2, 5E1 and 5E2 schematically show a main part of a liquid discharge head according to a second embodiment of the present invention. FIGS. 5A2, 5B2, 5C2, 5D2 and 5E2 are sectional views taken along a flow path, FIGS. 5A1, 5B1, 5C1, 5D1 and 5E1 are sectional views taken along the lines 5A1—5A1, 5B1—5B1, 5C1—5C1, 5D1—5D1 and 5E1—5E1 in FIGS. 5A2, 5B2, 5C2, 5D2 and 5E2, and FIG. 5A3 is a sectional view taken along the line 5A3—5A3 in FIG. 5A2.

Since a construction of the liquid discharge head according to the second embodiment including dimensional characteristics is fundamentally the same as that of the first embodiment, except that side stoppers 412*a* are formed along both side walls 407, detailed explanation thereof will be omitted. Incidentally, a height of each side stopper 412*a* from a top plate 402 is the same as a height of a stopper 412.

Now, a discharging operation of the liquid discharge head according to the second embodiment will be explained.

FIGS. 5A1 to 5A3 show an initial condition that a bubble is not generated.

When a heat generating body 410 generates heat upon application of energy such as electrical energy to the heat generating body 410, as shown in FIGS. 5B1 and 5B2, a bubble 440 is generated and a movable member 411 is displaced toward the top plate 402. In this condition, a discharge droplet 466 starts to be discharged from a discharge port 404.

Further, as shown in FIGS. 5C1 and 5C2, as the bubble 440 is grown, a free end 411*b* of the movable member 411 is contacted with a top end of the stopper 412, and then, the vicinity of the free end 411*b* of the movable member 411 is deformed as shown in FIG. 5C2, thereby contacting the movable member 411 with the side stoppers 412*a*.

In this case, since clearances between the stopper 412 and the side stoppers 412*a* and the sides of the movable member 411 are narrow, the flowing of liquid toward the upstream side from a bubble generating area, i.e., toward a common liquid chamber 406 is considerably regulated. As a result, a pressure difference between the bubble generating area side and the common liquid chamber side with the interposition of the movable member 411 becomes great, with the result that the movable member 411 is sealingly urged against the side stoppers 412*a*. Accordingly, since the close contacting ability between the movable member 411 and the stopper 412 and the side stoppers 412*a* is enhanced, even when adequate clearances are provided between the movable member 411 and the side walls 407, the liquid does not leak through the clearances. With this arrangement, the sealing ability of the bubble generating area with respect to the common liquid chamber 406 is enhanced, with the result that the liquid does not leak toward the common liquid chamber 406, thereby preventing loss of the discharging force.

In this condition, a tail portion of the discharge droplet 466 forming the liquid post is grown.

Then, as shown in FIGS. 5D1 and 5D2, after the film boiling, the negative pressure within the bubble overcomes the shifting force of the liquid toward the downstream side in a flow path 3, and the bubble is contracted. As a result, the movable member 411 is displaced downwardly, thereby re-filling the liquid toward the discharge port 404. At this point, the liquid post comprised of the discharge droplet 466 discharged from the discharge port 404 is flying outwardly as a liquid droplet (not shown).

Thereafter, as shown in FIGS. 5E1 and 5E2, after the bubble 440 is completely extinguished, the movable member 411 is overshot and displaced downwardly from the initial condition. The overshooting is attenuated for a short time and the initial condition is restored.

As mentioned above, in the liquid discharge head according to the illustrated embodiment, since the heights of the stopper 412 and the side stoppers 412*a* and the clearances between the upper surface of the movable member 411 and the tip ends of the stopper 412 and the side stoppers 412*a* are selected to the dimensional values as mentioned above, the movable member 411 is positively contacted with the stopper 412 and the side stoppers 412*a,* with the result that the liquid discharging energy can be transmitted to the liquid efficiently and the liquid is discharged stably, thereby surely realizing the desired discharging property, similar to the first embodiment.

Further, when the bubble volume changing ratio and the movable member displacement volume changing ratio tend to increase, since the displacement of the movable member is regulated by the regulating portion, the going-round of the bubble toward the upper surface of the movable member is prevented, thereby obtaining the good discharging property.

(Third Embodiment)

Figure 6:
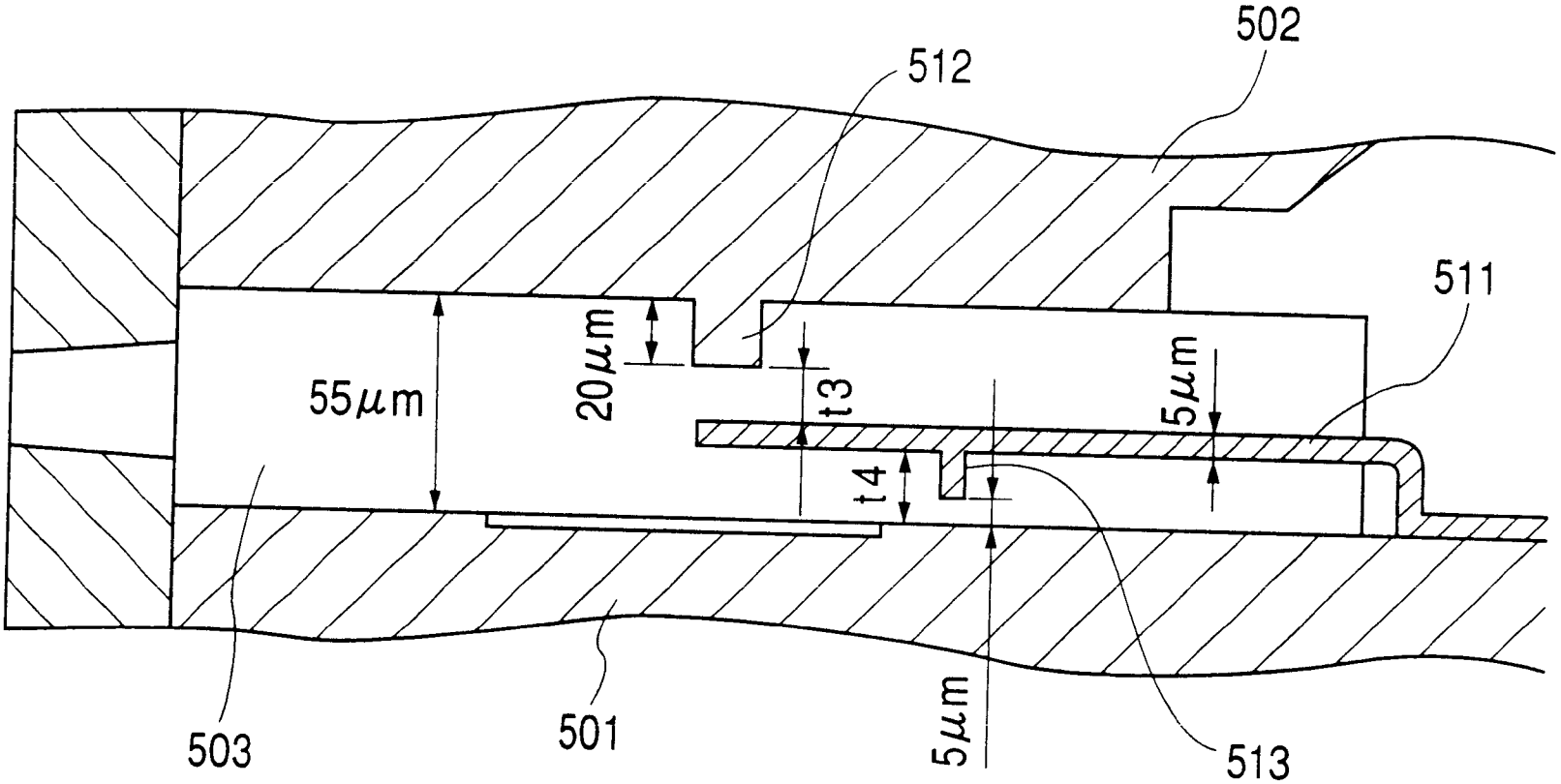
FIG. 6 is a schematic side sectional view of a liquid discharge head according to a third embodiment of the present invention.

FIG. 6 is a schematic side sectional view of a liquid discharge head according to a third embodiment of the present invention. Further, FIGS. 7A to 7E show liquid discharging steps from the liquid discharge head shown in FIG. 6.

First of all, a fundamental construction of the liquid discharge head according to the third embodiment will be explained.

A valve lower protruded portion 513 directing toward an element substrate 501 is formed on a lower surface of a movable member 511 in such a manner that clearance between the element substrate 501 and the lower surface of the movable member 511 becomes t4 as will be described later. As will be described later, the valve lower protruded portion 513 serves to contribute to enhancement of discharging energy by suppressing growth of a bubble toward an upstream side.

It is desirable that a position where the valve lower protruded portion 513 is formed is spaced apart from at least a stepped portion around a heat generating body 510 because the valve lower protruded portion 513 may be contacted with the element substrate 501 when the movable member 511 is displaced toward the element substrate 501. More specifically, it is desirable that the valve lower protruded portion is spaced apart from an effective bubble generating area by 5 $\mu$m or more. However, if the valve lower protruded portion is spaced apart from the bubble generating area too greatly, the effect for suppressing the growth of the bubble toward the upstream side cannot be achieved; therefore, it is desirable that the valve lower protruded portion is provided within a range from the effective bubble generating area of the heat generating body 510 to half of the length of the heat generating body.

Incidentally, since the fundamental constructions other than the above are the same as those of the liquid discharge head according to the first embodiment, detailed explanation thereof will be omitted.

Next, dimensions of various elements of the liquid discharge head will be explained.

A height of a flow path 503 is 55 $\mu$m, a thickness of the movable member 511 is 5 $\mu$m, clearance between the valve lower protruded portion 513 and the upper surface of the element substrate 501 in a condition that the bubble is not generated (the movable member 511 is not displaced) is 5 $\mu$m, and a distance between a flow path wall surface of the top plate 502 and a tip end of a stopper 512, i.e., a height of the stopper 512 is 20 $\mu$m. When the elements have such values, clearance t3 between the tip end of the stopper 512 and the upper surface of the movable member 511 becomes 10 to 15 $\mu$m, and, the clearance t4 between the element substrate 501 and the lower surface of the movable member 511 is selected to a range from 20 to 15 $\mu$m so that "t3+t4" becomes 30 $\mu$m.

Next, a discharging operation of the liquid discharge head according to the third embodiment will be explained.

Figure 7A:
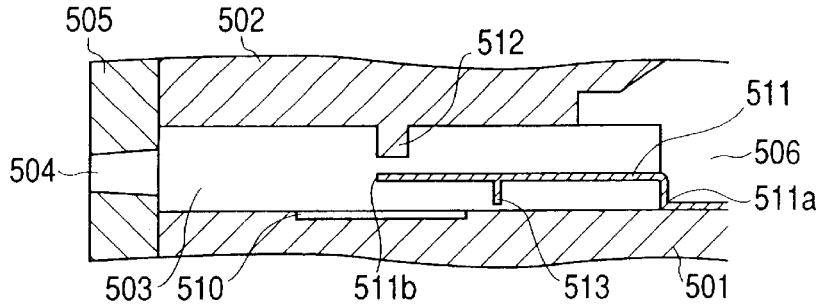
FIGS. 7A, 7B, 7C, 7D and 7E are views for explaining liquid discharging steps from the liquid discharge head of FIG. 6.

FIG. 7A shows an initial condition that the bubble is not generated.

Figure 7B:
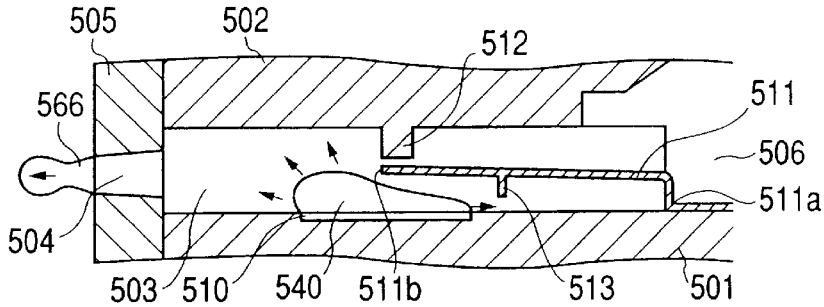

When the heat generating body 510 generates heat by applying energy such as electrical energy to the heat generating body 510, as shown in FIG. 7B, the bubble 540 is generated and the movable member 511 is displaced toward the top plate 502. In this condition, a discharge droplet 566 starts to be discharged from the discharge port 504.

Figure 7C:
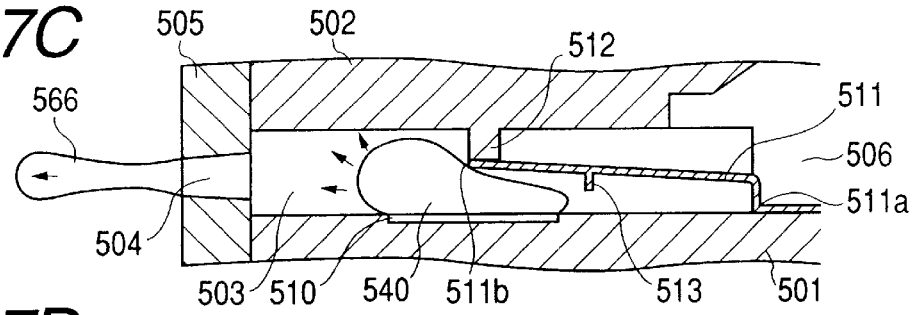

Further, as shown in FIG. 7C, as the bubble 540 is grown, a free end 511*b* of the movable member 511 is contacted with the tip end of the stopper 512. In this case, although the bubble 540 tries to grow also toward the upstream side, the upstream growing of the bubble is suppressed by the valve lower protruded portion 513. As a result, the bubble 540 is further grown toward the discharge port 504.

In this condition, a tail portion of the discharge droplet 566 forming the liquid post is grown.

Figure 7D:
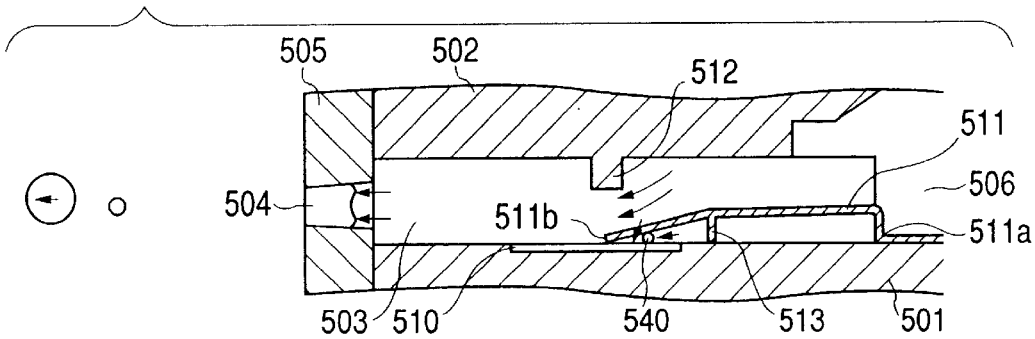

Then, as shown in FIG. 7D, after the film boiling, the negative pressure within the bubble overcomes the shifting force of the liquid toward the downstream side in the flow path 503, and the bubble is contracted. As a result, the movable member 511 is displaced downwardly, and the re-filling of the liquid toward the discharge port 504 is effected in a condition that the valve lower protruded portion 513 of the movable member 511 is contacted with the element substrate 501. At this point, the liquid post comprised of the discharge droplet 566 discharged from the discharge port 504 is flying outwardly as a liquid droplet.

Figure 7E:
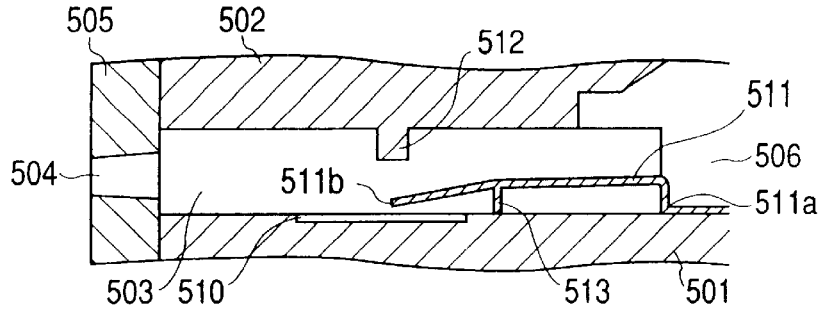

Thereafter, as shown in FIG. 7E, after the bubble 540 is completely extinguished, the movable member 511 is overshot and displaced downwardly from the initial condition. In this case, since the valve lower protruded portion 513 is contacted with the element substrate 501, even when the free end 511*b* of the movable member 511 is displaced downwardly due to the overshooting, there is adequate clearance between the free end 511*b* and the element substrate 501, thereby preventing the contact between the free end 511*b* and the element substrate 501, which could otherwise lead to damage of the free end 511*b* and/or the surface of the element substrate 501. Further, when the valve lower protruded portion 513 is contacted with the element substrate 501, since shock due to the contact is absorbed, a time period required for attenuating the overshooting is shortened.

Incidentally, also in this embodiment, side stoppers similar to those in the second embodiment may be provided at an upstream side of the stopper 512.

As mentioned above, in the liquid discharge head according to the illustrated embodiment, since the height of the stopper 512 and the clearance between the upper surface of the movable member 511 and the tip end of the stopper 512 are selected to the dimensional values as mentioned above, the movable member 511 is positively contacted with the stopper 512, with the result that the liquid discharging energy can be transmitted to the liquid efficiently and the liquid can be discharged stably, thereby surely realizing the desired discharging property, similar to the first and second embodiments.

Further, since the valve lower protruded portion 513 is formed on the lower surface of the movable member 511, the growth of the bubble 540 toward the discharge port 540 is promoted to enhance the discharging efficiency and the damage of the free end 511*b* and/or the surface of the element substrate 501 due to the overshooting can be prevented.

Further, when the bubble volume changing ratio and the movable member displacement volume changing ratio tend to increase, since the displacement of the movable member is regulated by the regulating portion, the going-round of the bubble toward the upper surface of the movable member is prevented, thereby obtaining a good discharging property.

(Fourth Embodiment)

Figure 8:
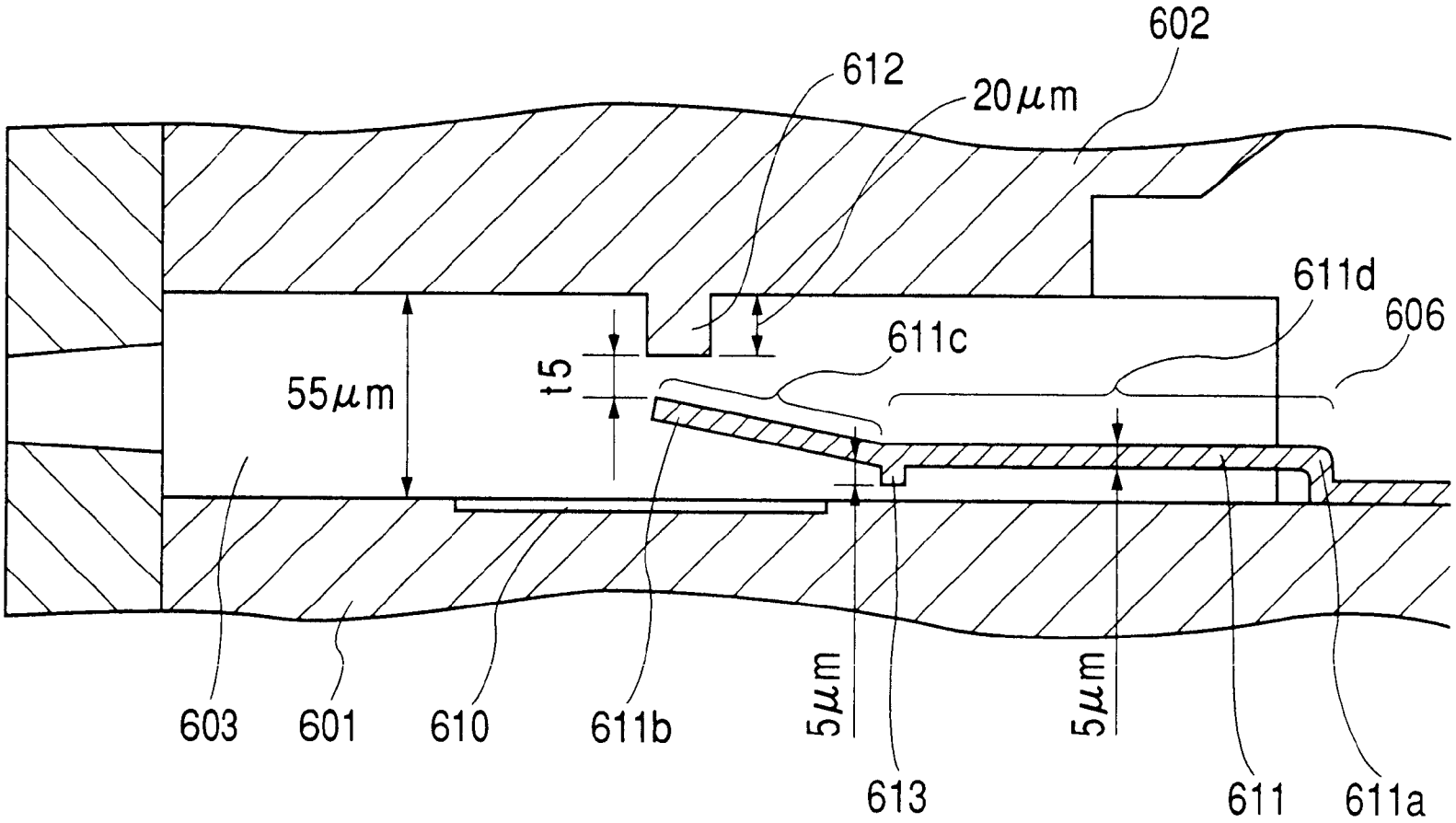
FIG. 8 is a schematic side sectional view of a liquid discharge head according to a fourth embodiment of the present invention.

FIG. 8 is a schematic side sectional view showing a main part of a liquid discharge head according to a fourth embodiment of the present invention. Further, FIGS. 9A to 9E show liquid discharging steps from the liquid discharge head shown in FIG. 8.

First of all, a fundamental construction of the liquid discharge head according to the fourth embodiment will be explained.

A movable member 611 comprises a parallel portion 611*d* parallel with a surface of an element substrate 601 in an initial condition, and an upper camber portion 611*c* curved obliquely and upwardly from a valve lower protruded portion 613 formed on a lower surface of the movable member and protruded toward the element substrate 601 to a free end 611*b*. By providing the movable member having such a configuration, for example, in comparison with the liquid discharge head of the third embodiment, a cross-sectional area of the flow path at the upstream side of the movable member 611 can be increased.

Incidentally, since fundamental constructions other than the above are the same as those of the liquid discharge head according to the first embodiment, detailed explanation thereof will be omitted.

Next, dimensions of various elements of the liquid discharge head will be explained.

A height of a flow path 603 is 55 $\mu$m, a thickness of the movable member 611 is 5 $\mu$m, a clearance between the valve lower protruded portion 613 and the upper surface of the element substrate 601 in a condition that the bubble is not generated (the movable member 611 is not displaced) is 5 $\mu$m, and a distance between a flow path wall surface of the top plate 602 and a tip end of a stopper 612, i.e., a height of the stopper 612 is 20 $\mu$m. When the elements have such values, clearance t5 between the tip end of the stopper 612 and the free end of the movable member 611 becomes 10 to 15 $\mu$m.

Next, a discharging operation of the liquid discharge head according to the third embodiment will be explained with reference to FIGS. 9A to 9E.

Figure 9A:
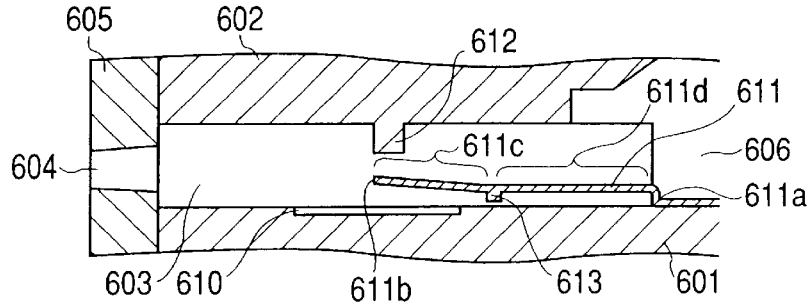
FIGS. 9A, 9B, 9C, 9D and 9E are views for explaining liquid discharging steps from the liquid discharge head of FIG. 8.

FIG. 9A shows an initial condition that the bubble is not generated.

Figure 9B:
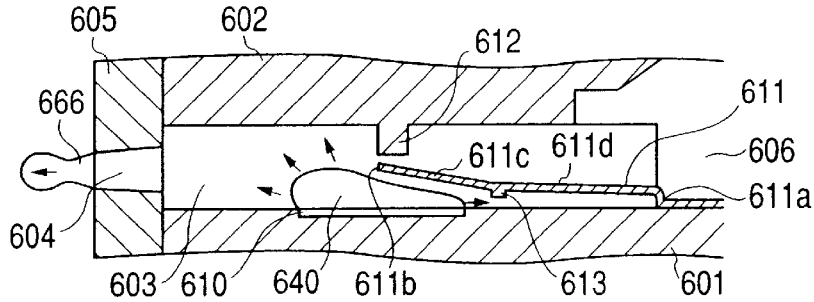

When a heat generating body 610 generates heat by applying energy such as electrical energy to the heat generating body 610, as shown in FIG. 9B, a bubble 640 is generated and the movable member 611 is displaced toward the top plate 602. In this condition, a discharge droplet 666 starts to be discharged from a discharge port 604.

Figure 9C:
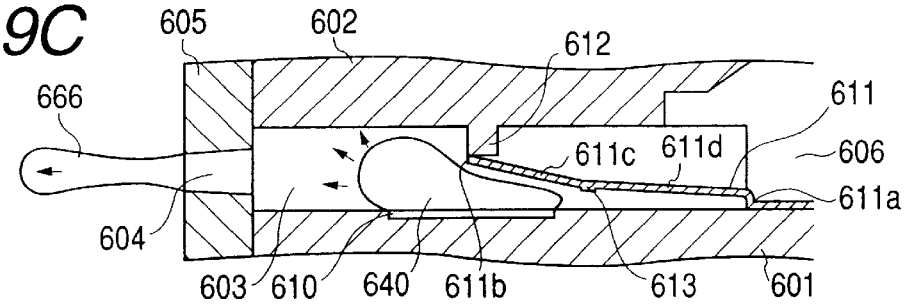

Further, as shown in FIG. 9C, as the bubble 640 is grown, the free end 611*b* of the movable member 611 is contacted with the tip end of the stopper 612. In this case, although the bubble 640 tries to grow also toward the upstream side, the upstream growing of the bubble is suppressed by the valve lower protruded portion 613. As a result, the bubble 640 is further grown toward the discharge port 604. Further, since the movable member 611 has the upper camber portion 611*c*, a displacement amount of the movable member 611 from the initial condition until the movable member is contacted with the stopper 612 is small, and, since an upper displacement amount of the parallel portion 611*d* is also small, even in a condition that the free end 611*b* is contacted with the stopper 612, an adequate cross-sectional area of the flow path at an upstream side of the movable member 611 is maintained.

In this condition, a tail portion of the discharge droplet 666 forming the liquid post is grown.

Figure 9D:
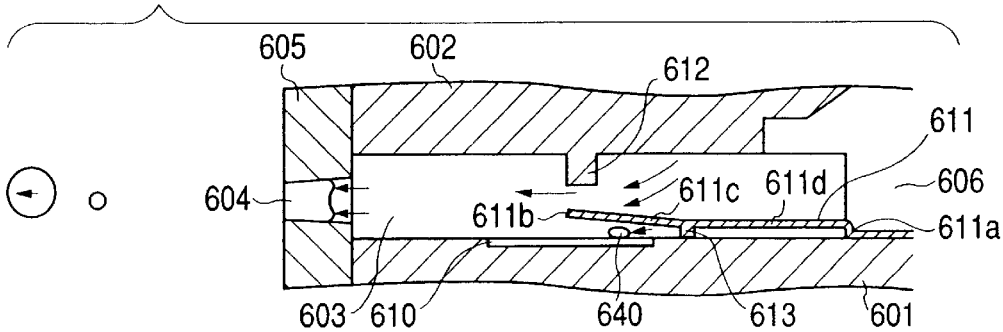

Then, as shown in FIG. 9D, after the film boiling, the negative pressure within the bubble overcomes the shifting force of the liquid toward the downstream side in the flow path 603, and the bubble 640 is contracted. As a result, the movable member 611 is displaced downwardly, and the re-filling of the liquid toward the discharge port 604 is effected in a condition that the valve lower protruded portion 613 of the movable member 611 is contacted with the element substrate 601. As mentioned above, since the adequate cross-sectional area of the flow path at the upstream side of the movable member 611 is maintained, the flow path resistance at the upstream side of the movable member 611 during the re-filling operation can be reduced, thereby enhancing the re-filling efficiency.

At this point, the liquid post comprised of the discharge droplet 666 discharged from the discharge port 604 is flying outwardly as a liquid droplet.

Figure 9E:
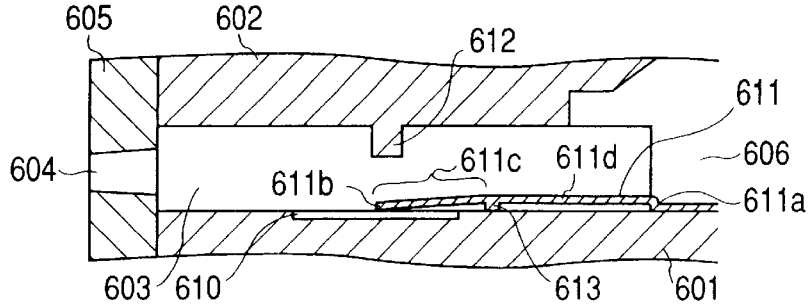

Thereafter, as shown in FIG. 9E, after the bubble 640 is completely extinguished, the movable member 611 is overshot and displaced downwardly from the initial condition. In this case, since the movable member 611 has the upper camber portion 611*c*, the clearance between the free end 611*b* and the element substrate 601 is great, and, thus, even when the free end 611*b* is displaced downwardly due to the over shooting, the contact between the free end 611*b* and the element substrate 601, which leads to damage of the free end 611*b* and/or the surface of the element substrate 601, can be prevented. Further, when the valve lower protruded portion 613 is contacted with the element substrate 601, since shock due to the contact is absorbed, a time period required for attenuating the overshooting is shortened.

Incidentally, also in this embodiment, side stoppers similar to those in the second embodiment may be provided at an upstream side of the stopper 612. In this case, it is preferable that the side stoppers be configured so that they are located along the inclination of the upper camber portion 611*c* in a condition that the free end 611*b* is contacted with the stopper 612.

As mentioned above, in the liquid discharge head according to the illustrated embodiment, since the height of the stopper 612 and the clearance between the free end 611*b* of the movable member 611 and the tip end of the stopper 612 are selected to the dimensional values as mentioned above, the free end 611*b* is positively contacted with the stopper 612, with the result that the liquid discharging energy can be transmitted to the liquid efficiently and the liquid is discharged stably, thereby surely realizing the desired discharging property, similar to the first to third embodiments.

Further, since the movable member 611 has the upper chamber portion 611*c*, an adequate cross-sectional area of the flow path at the upstream side of the movable member 611 is maintained, and, thus, the flow path resistance during the re-filling operation is reduced, thereby enhancing the re-filling efficiency.

Further, when the bubble volume changing ratio and the movable member displacement volume changing ratio tend to increase, since the displacement of the movable member is regulated by the regulating portion, the going-round of the bubble toward the upper surface of the movable member is prevented, thereby obtaining a good discharging property.

(Fifth Embodiment)

Figure 10:
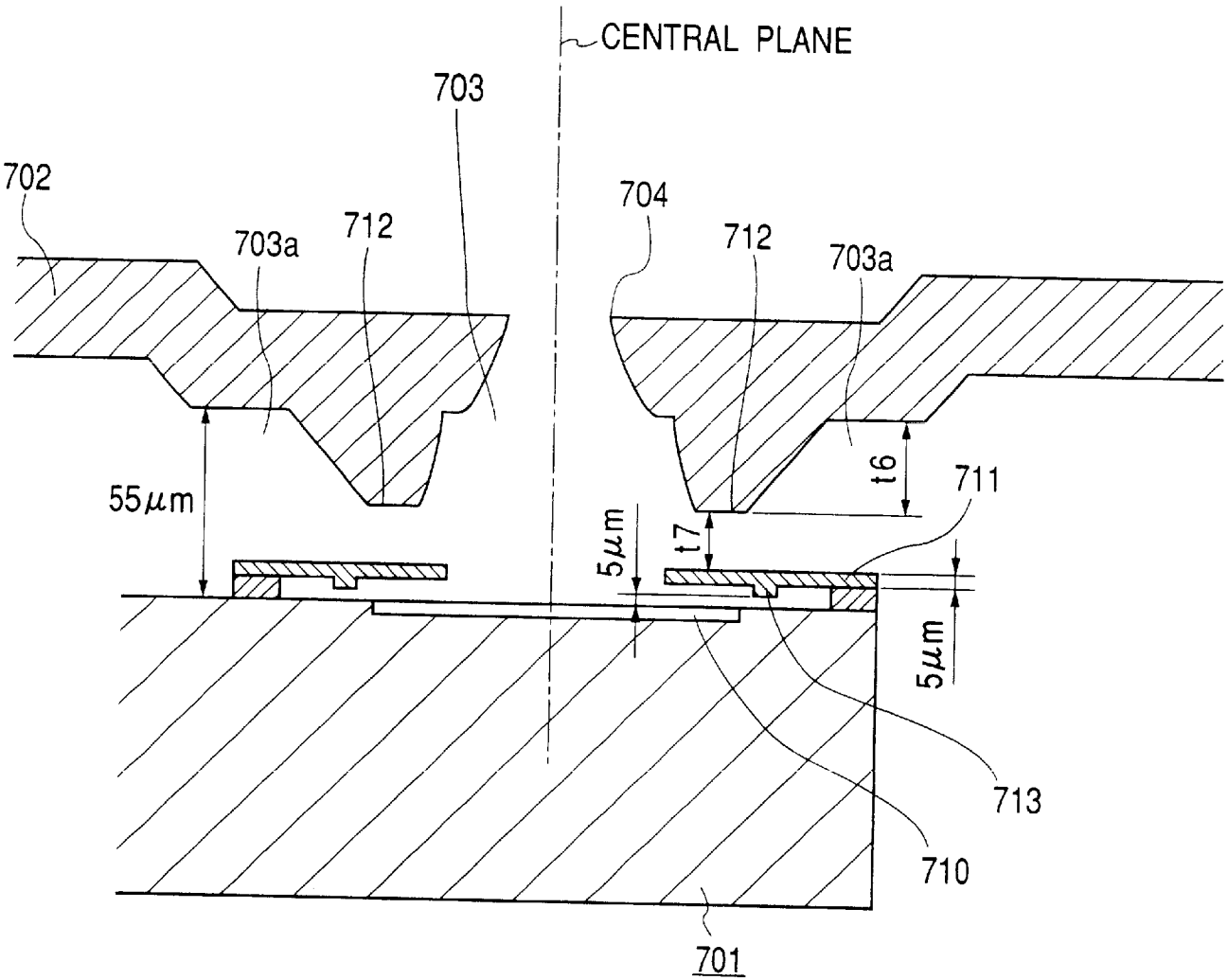
FIG. 10 is a schematic side sectional view of a liquid discharge head of side shooter type according to the fourth embodiment.

FIG. 10 is a schematic side sectional view showing a main part of a liquid discharge head of side shooter type in which a heat generating body is opposed to a discharge port in a parallel plane, according to a fifth embodiment of the present invention.

First of all, a fundamental construction of the liquid discharge head according to this embodiment will be explained.

A heat generating body 710 on an element substrate 701 is opposed to a discharge port 704 formed in a top plate 702. The discharge port 704 is communicated with a flow path 703 passing across the heat generating body 710. A bubble generating area is located in the vicinity of a contact surface between the heat generating body 710 and the liquid. Two movable members 711 provided at their lower surfaces with valve lower protruded portions 713 are supported on the element substrate 701, and the movable members 711 are positioned symmetrically with respect to a plane passing through a center of the heat generating body 710. Free ends of the movable members 711 are opposed to each other on the heat generating body 710. The movable members 711 have the same projection areas projected on the heat generating body 710, and the free ends of the movable members 711 are spaced apart from each other by a desired distance. When it is assumed that the heat generating body 710 is divided by a division wall passing through the center of the heat generating body 710, the movable members 711 are located so that the free ends of the movable members 711 are positioned in the vicinity of centers of the divided heat generating bodies 710.

The top plate 702 is provided with stopper 712 for regulating displacement of the movable members 711 within a certain range. In the liquid flow from a common liquid chamber 706 to the discharge port 704, a low flow path resistance area 703*a* having lower flow path resistance than that in the flow path 703 is provided at an upstream side of the stoppers 712. In a flow path structure in the low flow path resistance area 703*a*, resistance received from the flow path during the shifting movement of the liquid is reduced by increasing the flow path area thereof more than the flow path area of the flow path 703.

Next, dimensions of various elements of the liquid discharge head will be explained.

A height of the flow path 703 is 55 $\mu$m, a thickness of the movable member 711 is 5 $\mu$m, and a clearance between the valve lower protruded portion 713 and the upper surface of the element substrate 701 in a condition that the bubble is not generated (the movable member 711 is not displaced) is 5 $\mu$m.

Further, when it is assumed that a height from the flow path wall surface of the top plate 702 to the tip end of the stopper 712 is t6 and clearance between the upper surface of the movable member 711 and the tip end of the stopper 712 is t7, in a case where t6 is 30 $\mu$m or more, a stable liquid discharging property can be obtained by selecting t7 to 15 $\mu$m or less, and, in a case where t6 is 20 $\mu$m or more, t7 is preferably 25 $\mu$m or less.

Further, when t6 is 20 $\mu$m, t7 is selected to be 10 to 15 $\mu$m, and they may be selected within a range from 20 to 15 $\mu$m so that, in combination, the sum of t7 and the clearance between the element substrate 701 and the lower surface of the movable member 711 become 30 $\mu$m, Further, each movable member 711 may have an upper camber portion as does the movable member in the fourth embodiment. In this case, when it is assumed that clearance between the free end of the movable member 711 and the tip end of the stopper 712 is t7, in a case where t6 is 20 $\mu$m, t7 may be selected to be 10 to 15 $\mu$m.

Next, the characteristic function and effect obtained by the structure according to the illustrated embodiment will be explained.

Figure 11A:
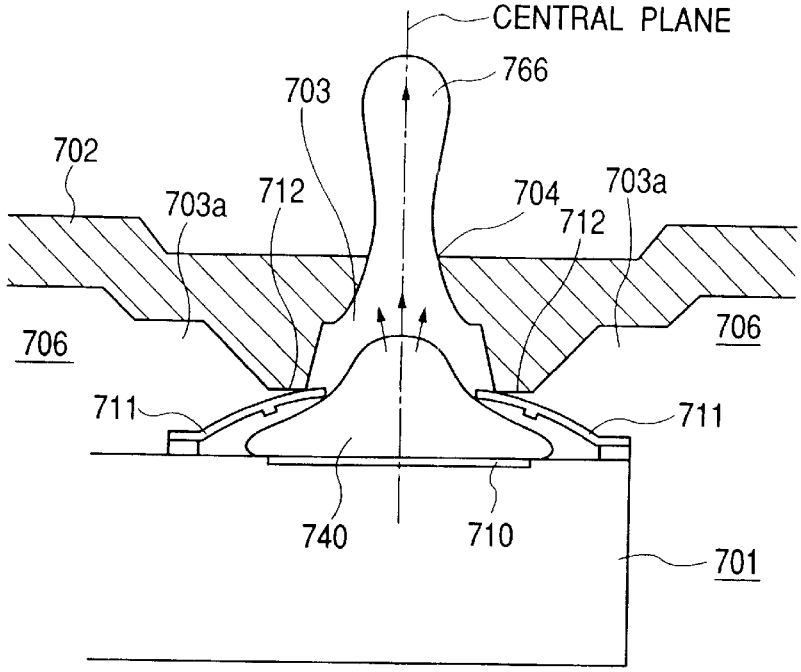
FIGS. 11A and 11B are views showing a condition that a bubble is grown at a maximum state in the liquid discharge head of FIG. 10.

FIG. 11A shows a condition that a part of the liquid filling the bubble generating area is heated by the heat generating body 710 and the bubble 740 due to the film boiling is grown to the maximum. In this case, the liquid in the flow path 703 is shifted toward the discharge port 704 by pressure based on the generation of the bubble 740, the movable members 711 are displaced by the growth of the bubble 740, and a discharge droplet 766 is about to discharge from the discharge port 704. Although the liquid flowing toward the common liquid chamber 706 becomes a great flow in the low flow path resistance areas 703*a,* when two movable members 711 are displaced until they are adjacent to or contacted with the respective stoppers 712, since further displacement of the movable members is regulated, the shifting movement of the liquid toward the common liquid chamber 706 is also greatly regulated there. At the same time, the growth of the bubble 740 toward the upstream direction is also regulated by the movable members 711. However, since the shifting force of the liquid toward the upstream direction is great, a part of the bubble 740 the growth of which is regulated by the movable members 711 passes through gaps (not shown) between the side walls defining the flow path 703 and the sides of the movable members 711 and rises toward the upper surfaces of the movable members 711.

After the film boiling, when the contraction of the bubble 740 is started, since the great force of the liquid directing toward the upstream direction remains at this point, the movable members 711 are still contacted with the stoppers 712, and the liquid is shifted toward the upstream direction from the discharge port 704 by the contraction of the bubble 740. Accordingly, at this point, the meniscus is greatly retracted from the discharge port 704 into the flow path 703, thereby separating the liquid post connected to the discharge droplet 766 quickly with a strong force. As a result, the number of liquid droplets or satellites remaining outside of the discharge port 704 is reduced.

Figure 11B:
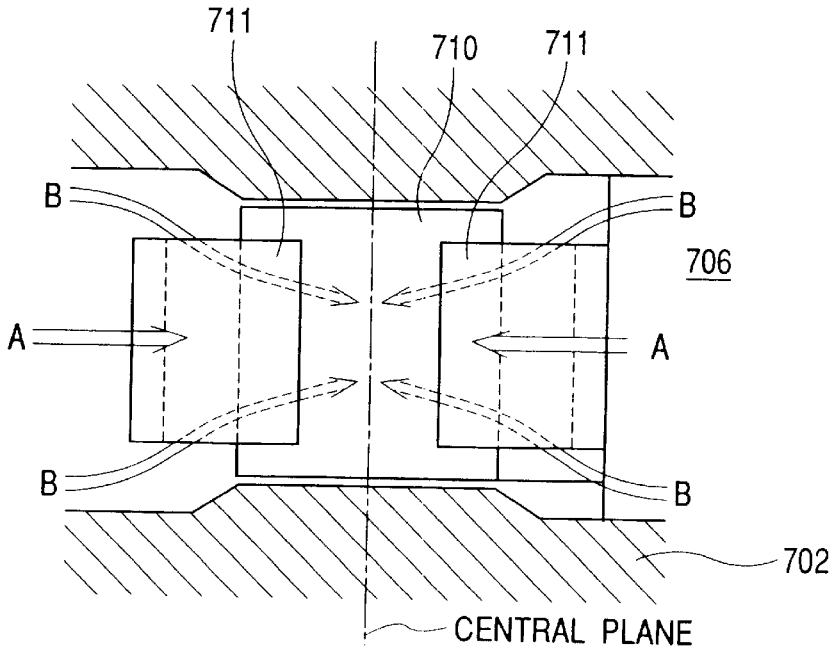

When the bubble extinguishing step is almost finished, in the low flow path resistance areas 703*a,* the repelling forces (restoring forces) of the movable member overcome the shifting force of the liquid toward the upstream direction, with the result that the movable members 711 are displaced downwardly and the flow of the liquid toward the downstream direction is started in the low flow path resistance areas 703*a.* At the same time, since the flow path resistance is small, the liquids flowing toward the downstream direction in the low flow path resistance areas 703*a* become great flows quickly and flow into the flow path 703 through the stoppers 712. In FIG. 11B, such liquid flows in the bubble extinguishing step are shown by the arrows A and B. The liquid flows A indicate components of the liquid flowing from the common liquid chamber 706 toward the discharge port 704 through the upper surfaces (opposite to the heat generating body) of the movable members 711, and the liquid flows B indicate components flowing through the sides of the movable members 711 and on the heat generating body 710.

In this way, according to the illustrated embodiment, by supplying the discharging liquid from the low flow path resistance areas 703*a,* the re-filling ability can be enhanced at a higher speed. Further, since the common liquid chamber 706 adjacent to the low flow path resistance areas 703*a* further reduces the flow path resistance, the further high speed re-filling is permitted.

Further, in the extinguishing step for the bubble 740, the rising bubbles 41 promote the liquid flows from the low flow path resistance areas 703*a* to the bubble generating area, with the result that the extinction of the bubble is swiftly completed with the aid of the high speed retraction of the meniscus from the discharge port 704. Particularly, due to the presence of the liquid flows generated by the rising bubbles 41, the bubbles are not almost trapped at corners of the flow path 703 and the movable members 711.

Incidentally, also in this embodiment, side stoppers as shown in the second embodiment may be provided at an upstream side of the stoppers 712.

As mentioned above, in the liquid discharge head according to the illustrated embodiment, since the heights of the stoppers 712 and the clearances between the upper surfaces of the movable members 711 and the tip ends of the stoppers 712 are selected to the dimensional values as mentioned above, the movable members 711 are positively contacted with the stoppers 712, with the result that the liquid discharging energy can be transmitted to the liquid efficiently and the liquid is discharged stably, thereby surely realizing the desired discharging property, similar to the first to fourth embodiments.

Further, when the bubble volume changing ratio and the movable member displacement volume changing ratio tend to increase, since the displacement of the movable member is regulated by the regulating portion, the going-round of the bubble toward the upper surface of the movable member is prevented, thereby obtaining a good discharging property.

<Movable Member>

Next, the movable member used in the liquid discharge heads according to the above-mentioned embodiment will be fully described. Incidentally, in the following description, the reference numerals used in the first embodiment are used for designating various elements.

Material for the movable member 11 may be a metal having high durability such as silver, nickel, gold, iron, titanium, aluminum, platinum, tantalum, stainless steel or bronze phosphide or alloys thereof, or a resin having a nitrile group such as acrylonitrile, butadiene or styrene, or a resin having an amide group such as polyamide, a resin having a carboxyl group such as polycarbonate, a resin having an aldehyde group such as polyacetal, a resin having a sulfone group such as polysulfone, or a resin such as a liquid crystal polymer or compounds thereof, a metal having high ink resistance such as gold, tungsten, tantalum, nickel, stainless steel or titanium or alloys thereof, or, regarding the ink-resistance ability, a material coated by such metal, or a resin having an amide group such as polyamide, a resin having an aldehyde group such as polyacetal, a resin having a ketone group such as polyether-ether ketone, a resin having an imide group such as polyimide, a resin having a hydroxil group such as phenol resin, a resin having an ethyl group such as polyethylene, a resin having an alkyl group such as polypropylene, a resin having an epoxy group such as epoxy resin, a resin having an amino group such as melamine resin, a resin having a methylol group such as xylene resin or compounds thereof, or ceramics such as silicon dioxide or silicon nitride or compounds thereof.

Next, a positional relationship between the heat generating body 10 and the movable member 11 will be described. By the optimum positional relationship between the heat generating body 10 and the movable member 11, the flow of the liquid during the bubble generating operation of the heat generating body 10 can be controlled properly to utilize it effectively.

Figure 12:
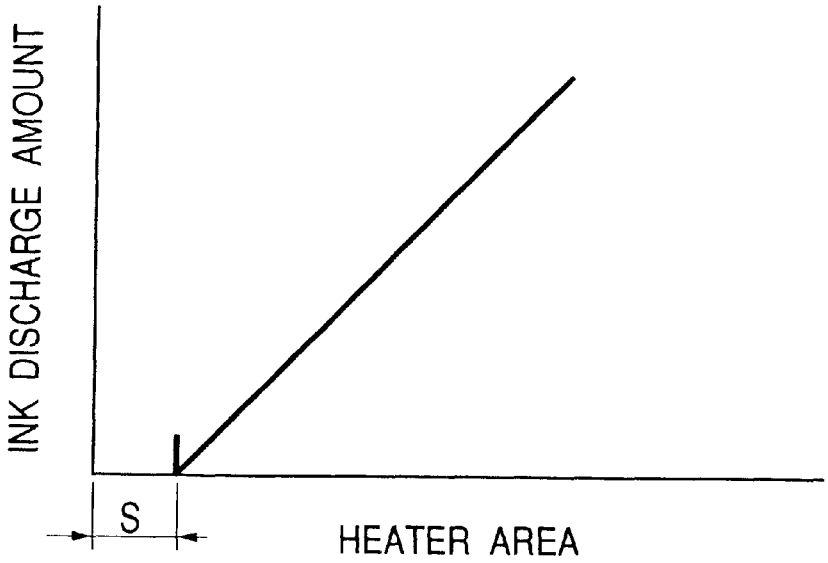
FIG. 12 is a graph showing a relationship between an area of a heat generating body and an ink discharge amount.

In the conventional ink jet recording method, i.e., the so-called bubble jet recording method in which abrupt change in volume is caused in ink by applying energy such as thermal energy, and the ink is discharged from the discharge port 4 by an acting force based on this condition change thereby effecting the recording by adhering the ink onto the recording medium, as shown in FIG. 12, it can be seen that the area of the heat generating body is proportional to the ink discharge amount, but a non-bubbling effective area S not contributing to the ink discharging exists. Further, from the state of the burned ink on the heat generating body 10, it can be understood that the non-bubbling effective area S is located around the heat generating body 10. From these results, a width of about 4 μm around the heat generating body is regarded as not contributing to the bubbling.

Accordingly, in order to utilize the bubbling pressure effectively, a zone immediately above the bubbling effective area corresponding to the width of about 4 μm around the heat generating body 10 is an area effectively acting on the movable member 11. In the present invention, it is very important that, by noticing the division of a step for independently effecting the actions of the bubble acting on the liquids in the flow path 3 at the upstream side and the downstream side of the substantially central area (actually, a range of ±10 μm from the center in the liquid flowing direction) of the bubble generating area and a step for synthetically effecting such action are divided, the movable member 11 is positioned in such a manner that only the upstream side of the central area is opposed to the movable member 11. In the illustrated embodiment, while an example that the bubbling effective area is the area corresponding to the width of about 4 μm around the heat generating body 10 was explained, in dependence upon the kind or forming method of the heat generating body 10, the present invention is not limited to such an example.

<Element Substrate>

Next, the element substrate used in the liquid discharge heads according to the above-mentioned embodiment will be fully described. Incidentally, in the following description, the reference numerals used in the first embodiment are used for designating various elements.

Now, the construction of the element substrate 1 on which the heat generating body 10 for applying the heat to the liquid is formed will be fully explained.

Figure 13A:
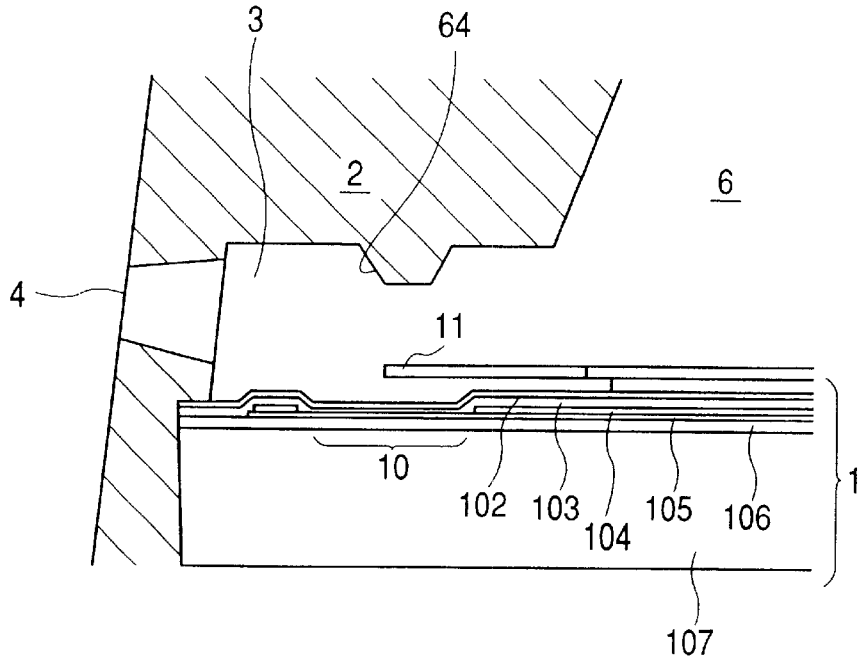
FIGS. 13A and 13B are schematic side sectional views for explaining a construction of an element substrate of the liquid discharge head according to the present invention.
Figure 13B:
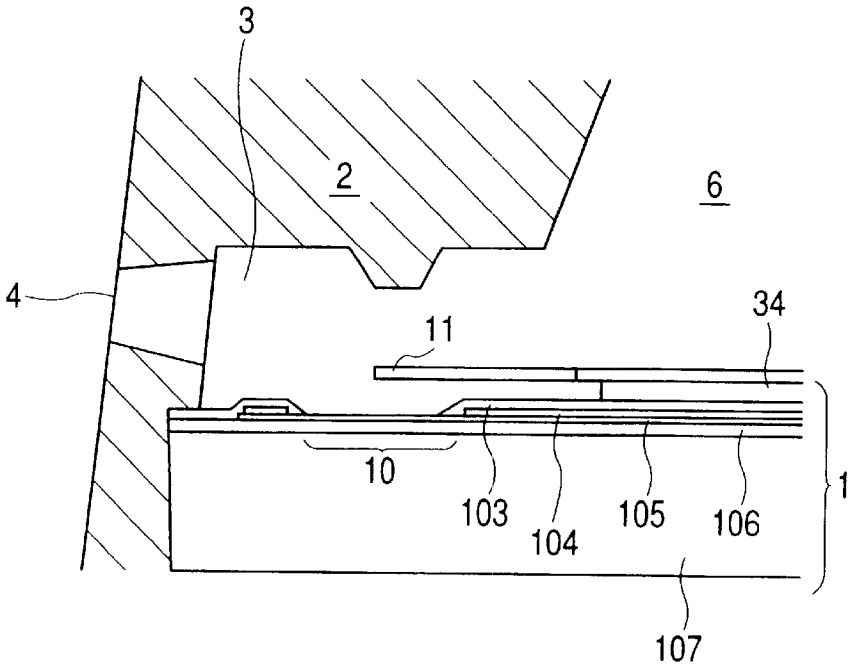

FIGS. 13A and 13B are schematic side sectional views showing a main part of a liquid discharge head as an example of the present invention, for explaining the construction of the element substrate, wherein FIG. 13A shows a liquid discharge head having a protection film which will be described later, and FIG. 13B shows a liquid discharge head having no protection film.

The grooved top plate 2 having grooves defining the flow paths 3 is disposed on the element substrate 1.

In the element substrate 1, a silicon oxide film or a silicon nitride film 106 having a purpose of insulation and heat accumulation is formed on a substrate 107 made of silicon, and an electrical resistance layer 105 (having a thickness of 0.01 to 0.2 μm) made of hafnium boride ($HfB_2$), tantalum nitride (TaN) or tantalum aluminium (TaA) constituting the heat generating bodies 10 and wiring electrodes 104 made of aluminium (having a thickness of 0.2 to 1.0 μm) are patterned on the film, as shown in FIG. 13A. By applying voltage from the wiring electrodes 104 to the resistance layer 105, current is flown through the resistance layer 105, thereby heating the latter. A protection film 103 made of silicon oxide or silicon nitride (having a thickness of 0.1 to 2.0 μm) is formed on the resistance layer 105 between the wiring electrodes 104, and an anti-cavitation layer 102 (having a thickness of 0.1 to 0.6 μm) made of tantalum is formed on the protection film, thereby protecting the resistance layer 105 from liquids such as the ink.

Particularly, since the pressure and shock wave generated in generation and extinction of the bubble are very strong to considerably reduce the durability of hard and fragile oxide film, metal material such as tantalum (Ta) is used as the anti-cavitation layer 102.

Further, by the combination of the liquid, flow path structure and resistance material, an arrangement in which the resistance layer 105 does not require the protection film 103 may be provided, and an example thereof is shown in FIG. 13B. Material for the resistance layer 105 not requiring the protection film 103 may be iridium/tantalum/aluminium alloy.

In this way, in the structure of the heat generating body 10 in the aforementioned embodiments, only the resistance layer 105 (heat generating portion) between the electrodes 104 may be provided or the protection film 103 for protecting the resistance layer 105 may also be included.

In the aforementioned embodiments, while an example that the element having the heat generating portion constituted by the resistance layer 105 capable of generating heat in response to an electrical signal is used as the heat generating body 10 was explained, the present invention is not limited to such an example; any structure can be used so long as a bubble sufficient to discharge the discharging liquid is generated in the bubbling liquid. For example, a photo-thermal converter capable of generating heat by light such as laser or a heat generating body having a heat generating portion capable of generating heat by high frequency may be used.

Incidentally, on the element substrate 1, as well as the heat generating bodies constituted by the resistance layer 105 constituting the heat generating portions and the wiring electrodes for supplying the electrical signals to the resistance layer 105, functional elements such as transistors, diodes, latches and shift registers for selectively driving the heat generating bodies 10 (electrical/thermal converting elements) may integrally be formed by a semiconductor manufacturing process.

Figure 14:
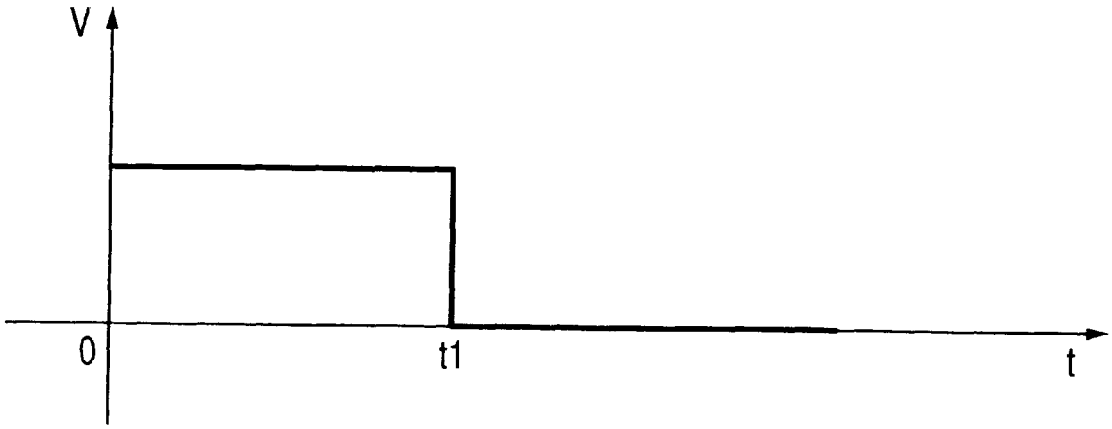
FIG. 14 is a graph showing a pulse wave form applied to the heat generating body.

Further, in order to drive the heat generating portion of the heat generating body 10 provided on the element substrate 1 to discharge the liquid, a rectangular pulse as shown in FIG. 14 is applied to the resistance layer 105 through the wiring electrodes 104, thereby abruptly heating the resistance layer 105 between the wiring electrodes 104. In the head according to the aforementioned embodiments, the heat generating body is driven by applying an electrical signal having voltage of 24 V, a pulse width of 7 μsec, a current of 150 μA and a frequency of 6 kHz, thereby discharging the ink as the liquid from the discharge port 4 by the above-mentioned operation. However, the conditions of the drive signal are not limited to those above, but any drive signal capable of bubbling the bubbling liquid properly can be used.

<Recording Apparatus>

Next, an example of a recording apparatus using the liquid discharge head explained in the aforementioned embodiments will be described.

Figure 15:
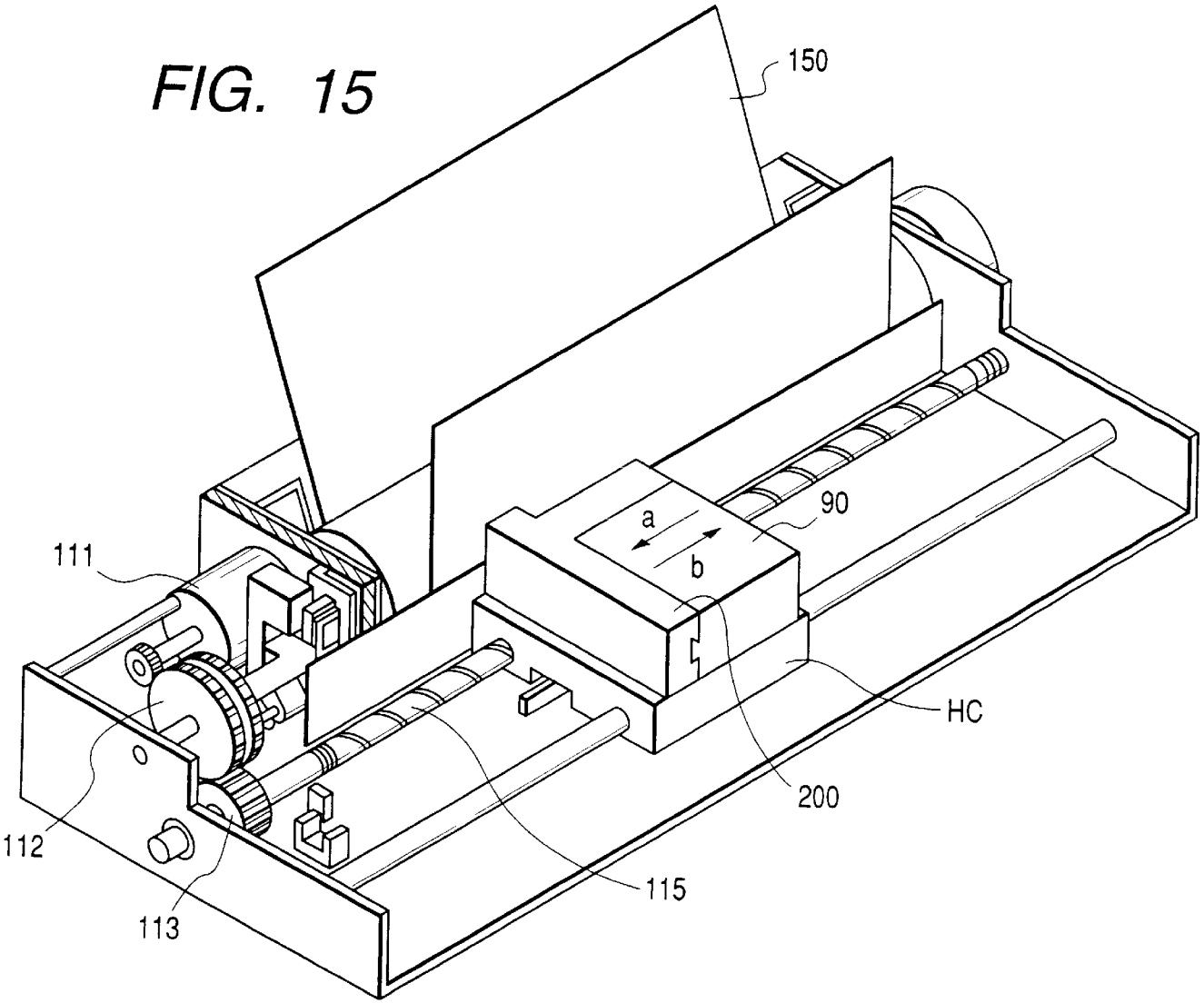
FIG. 15 is a schematic perspective view showing an example of a recording apparatus according to the present invention.

FIG. 15 is a schematic perspective view showing an example of a recording apparatus in which the above-mentioned liquid discharge head is incorporated and the ink is used as the discharging liquid. A carriage HC has thereon a liquid tank portion 90 for containing the ink, and a recording head portion 200 which is the liquid discharge head, and is reciprocally shifted in a width-wise direction of a recording medium 150 such as a recording paper conveyed by recording medium conveying means.

When a drive signal is supplied to liquid discharging means on the carriage HC from drive signal supplying means (not shown), the ink (recording liquid) is discharged from the recording head portion toward the recording medium in response to the drive signal.

Further, the recording apparatus according to the illustrated embodiment includes a motor 111 as a drive source for driving the recording medium conveying means and the carriage, gears 112, 113 for transmitting a power from the drive source to the carriage, and a carriage shaft 115. By this recording apparatus and a liquid discharging method effected by the recording apparatus, a recorded matter having a good image can be obtained by discharging the liquid onto the recording medium.

Figure 16:
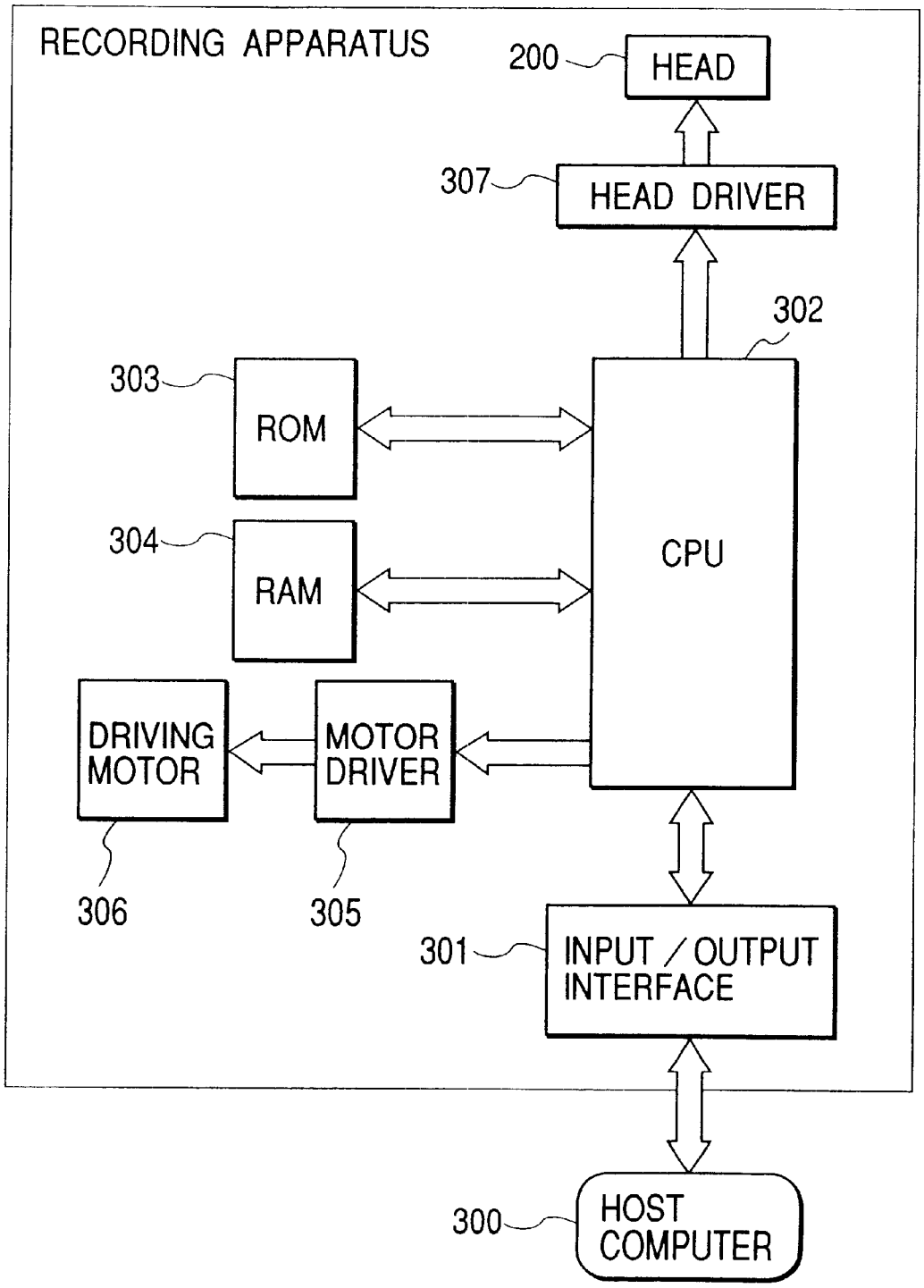
FIG. 16 is a block diagram of the entire recording apparatus for effecting ink jet recording by the liquid discharge head according to the present invention.

FIG. 16 is a block diagram of the entire recording apparatus for effecting the ink jet recording by the liquid discharge head according to the illustrated embodiments.

The recording apparatus receives print information from a host computer 300 as a control signal. The print information is temporarily stored in an input interface 301 within the recording apparatus and is converted into data processable in the recording apparatus and then is inputted to a CPU (central processing unit) 302 also acting as head drive signal supplying means. The CPU 302 serves to process the data inputted to the CPU 302 by using peripheral units such as a RAM (random access memory) 304 on the basis of control program stored in a ROM (read only memory) 303 and to convert it into data (image data) to be recorded.

Further, the CPU 302 forms drive data for driving a driving motor 306 for shifting the carriage HC on which the recording head portion is mounted and the recording medium in synchronism with the image data in order to record the image data at a proper position on the recording medium. The image data and the motor drive data are transmitted to the recording head portion 200 and the driving motor 306 through a head driver 307 and a motor driver 305, respectively, with the result that the recording head portion 200 and the driving motor 306 are driven at controlled timings, thereby forming the image.

The recording medium 150 which is used in such a recording apparatus and to which the liquid such as the ink is applied may be various papers, an OHP sheet, a plastic sheet used in a compact disc or decoration plate, cloth, a metallic sheet made of aluminium or copper, leather material such as cow leather, pig leather or synthetic leather, wood material such as wood or plywood, bamboo, ceramic material such as tile or a three-dimensional structure such as sponge.

Further, the recording apparatus can be embodied as a printer apparatus for effecting recording on various papers and an OHP sheet, a plastic recording apparatus for effecting recording on plastic material such as a compact disc, a metal recording apparatus for effecting recording on a metallic plate, a leather recording apparatus for effecting recording on leather, a wood recording apparatus for effecting recording on wood material, a ceramic recording apparatus for effecting recording on ceramic material, a recording apparatus for effecting recording on a three-dimensional structure such as sponge or a print apparatus for effecting recording on cloth.

Further, as the discharging liquid used in the liquid discharge head, liquid suitable to the recording medium used and recording conditions can be used.

As mentioned above, according to the present invention, since the height of the regulating portion is selected to be 20 $\mu$m or more and the first clearance defined by the movable member and the regulating portion in the flow path is selected to be 10 $\mu$m or more, the movable member can positively be contacted with the regulating portion to positively regulate the displacement amount of the movable member mechanically, and the influence of the regulating portion and the movable member upon the liquid flow toward the discharge port in the re-filling operation can be reduced, and the smooth supplying of liquid can be realized. Thus, the liquid discharging energy due to the bubble can be transmitted to the liquid efficiently, thereby discharging the liquid stably.

What is claimed is:

1. A liquid discharging method comprising the steps of:

providing a heat generating member for generating thermal energy for generating a bubble in a liquid, a discharge port for discharging the liquid, a flow path communicating with said discharge port and having a bubble generating area for generating the bubble in the liquid, a movable member having a free end and capable of being displaced as the bubble grows, and a regulating portion for regulating a displacement amount of said movable member, said flow path being formed by joining a substantially flat substrate including said heat generating member and said movable member to a top plate opposed to said substrate and including said regulating portion and the liquid being discharged from said discharge port by energy generated by generation of the bubble;

generating the bubble in the liquid by causing said heat generating member to generate heat and displacing said movable member upon growth of the bubble; and regulating the displacement of said movable member by said regulating portion when both a volume change ratio of the bubble and a displacement volume change ratio of said movable member tend to increase.

2. A liquid discharging method according to claim 1, wherein said regulating portion has a tip end regulating portion formed at a position opposed to the free end of said movable member.

3. A liquid discharging method according to claim 2, wherein said regulating portion has side regulating portions located at sides of said bubble generating area and formed at positions opposed to both lateral ends of said movable member.

4. A liquid discharging method according to claim 1, wherein a protruded height from a wall surface of said top plate defining an upper wall surface of said flow path to a tip end of the regulating portion is 20 $\mu$m or more, and a first clearance within said flow path formed by said movable member and said regulating portion in an initial condition that the bubble is not generated is 25 $\mu$m or less.

5. A liquid discharging method according to claim 4, wherein a second clearance within said flow path formed by a lower surface of said movable member and said substrate in the initial condition that the bubble is not generated is 5 $\mu$m or more.

6. A liquid discharging method according to claim 4, wherein a thickness of said movable member is about 5 $\mu$m.

7. A liquid discharging method according to claim 4, wherein a distance between a wall surface of said substrate defining a lower wall surface of said flow path and said upper wall surface which is a height of said flow path in said bubble generating area is about 55 $\mu$m.

8. A liquid discharging method according to claim 4, wherein the first clearance is 10 $\mu$m or more.

9. A liquid discharging method according to claim 4, wherein, when the protruded height is 30 $\mu$m or more, the first clearance is 15 $\mu$m or less.

10. A liquid discharging method according to claim 1, wherein said movable member has a protruded portion protruded from a lower surface of said movable member toward said substrate.

11. A liquid discharging method according to claim 10, wherein a protruded height from a wall surface of said top plate defining an upper wall surface of said flow path to a tip end of the regulating portion is 20 $\mu$m or more, and a first clearance within said flow path formed by said movable member and said regulating portion in an initial condition that the bubble is not generated is 25 $\mu$m or less.

12. A liquid discharging method according to claim 11, wherein another clearance within said flow path formed by said protruded portion and said substrate in the initial condition that the bubble is not generated is about 5 μm.

13. A liquid discharging method according to claim 11, wherein, when the protruded height is about 20 μm, the first clearance is within a range from 10 to 15 μm, and the sum of a value of the first clearance and a value of a second clearance within said flow path formed by a lower surface of said movable member and said substrate in the initial condition that the bubble is not generated is about 30 μm.

14. A liquid discharging method according to claim 11, wherein, when the protruded height is about 20 μm, the first clearance is within a range from 10 to 15 μm.

15. A liquid discharging method according to claim 1, wherein said movable member has a parallel portion parallel with a wall surface of said substrate defining a lower wall surface of said flow path, and an upper camber portion inclined from said parallel portion to an upper wall portion.

16. A liquid discharging method according to claim 1, wherein said discharge port is disposed above said heat generating member.

17. A liquid discharging method according to claim 16, wherein a plurality of said movable members are provided with respect to said one heat generating member, and said plurality of movable members are disposed symmetrically with respect to a bubbling center of said heat generating member.

18. A liquid discharge head comprising:

a heat generating member for generating thermal energy for generating a bubble in a liquid;

a discharge port for discharging the liquid;

a flow path communicating with said discharge port and having a bubble generating area for generating the bubble in the liquid;

a movable member having a free end and capable of being displaced as the bubble grows; and a regulating portion for regulating a displacement amount of said movable member, wherein said flow path is formed by joining a substantially flat substrate including said heat generating body and said movable member to a top plate opposed to said substrate and including said regulating portion, and the liquid is discharged from said discharge port by energy generated by generation of the bubble, and a protruded height from a wall surface of said top plate defining an upper wall surface of said flow path to a tip end of the regulating portion is 20 μm or more, and a first clearance within said flow path formed by said movable member and said regulating portion in an initial condition that the bubble is not generated is 25 μm or less.

19. A liquid discharge head according to claim 18, wherein said regulating portion has a tip end regulating portion formed at a position opposed to the free end of said movable member.

20. A liquid discharge head according to claim 19, wherein said regulating portion has side regulating portions located at sides of said bubble generating area and formed at positions opposed to both lateral ends of said movable member.

21. A liquid discharge head according to claim 19, wherein a second clearance within said flow path formed by a lower surface of said movable member and said substrate in the initial condition that the bubble is not generated is 5 μm or more.

22. A liquid discharge head according to claim 19, wherein a thickness of said movable member is about 5 μm.

23. A liquid discharge head according to claim 19, wherein a distance between a wall surface of said substrate defining a lower wall surface of said flow path and said upper wall surface which is a height of said flow path in said bubble generating area is about 55 μm.

24. A liquid discharge head according to claim 19, wherein the first clearance is 10 μm or more.

25. A liquid discharge head according to claim 19, wherein, when the protruded height is 30 μm or more, the first clearance is 15 μm or less.

26. A liquid discharge head according to claim 19, wherein said movable member has a protruded portion protruded from a lower surface of said movable member toward said substrate.

27. A liquid discharge head according to claim 26, wherein another clearance within said flow path formed by said protruded portion and said substrate in the initial condition that the bubble is not generated is about 5 μm.

28. A liquid discharge head according to claim 26, wherein, when the protruded height is about 20 μm, the first clearance is within a range from 10 to 15 μm, and the sum of a value of the first clearance and a value of a second clearance within said flow path formed by a lower surface of said movable member and said substrate in the initial condition that the bubble is not generated is about 30 μm.

29. A liquid discharge head according to claim 18, wherein said movable member has a parallel portion parallel with a wall surface of said substrate defining a lower wall surface of said flow path, and an upper camber portion inclined from said parallel portion to an upper wall portion.

30. A liquid discharge head according to claim 29, wherein, when the protruded height is about 20 μm, the first clearance is within a range from 10 to 15 μm.

31. A liquid discharge head according to claim 18, wherein said discharge port is disposed above said heat generating member.

32. A liquid discharge head according to claim 31, wherein a plurality of said movable members are provided with respect to said one heat generating member, and said plurality of movable members are disposed symmetrically with respect to a bubbling center of said heat generating member.

33. A recording apparatus comprising:

conveying means for conveying a recording medium; and holding means adapted to hold a liquid discharge head according to any one of claims 18 to 32 for effecting recording on the recording medium and capable of being reciprocally shifted in a direction transverse to a conveying direction of the recording medium.

* * * * *

UNITED STATES PATENT AND TRADEMARK OFFICE

CERTIFICATE OF CORRECTION

PATENT NO. : 6,578,952 B1
DATED : June 17, 2003
INVENTOR(S) : Sugiyama et al.

It is certified that error appears in the above-identified patent and that said Letters Patent is hereby corrected as shown below:

Column 1,
Line 17, “character” should read -- a character --.
Line 64, “energy” should read -- of energy --.

Column 3,
Line 44, “toward the” should be deleted.

Column 6,
Line 19, “constructural” should read -- structural --.

Column 8,
Line 2, “he” should read -- the --.

Column 11,
Line 50, “the further” should read -- further --.

Column 19,
Line 23, “over shooting,” should read -- overshooting, --.

Column 20,
Line 54, “30 μm,” should read -- 30μm. --.

Signed and Sealed this

Twenty-fifth Day of November, 2003

JAMES E. ROGAN
*Director of the United States Patent and Trademark Office*